US011378244B2

(12) United States Patent
Sugiyama et al.

(10) Patent No.: US 11,378,244 B2
(45) Date of Patent: Jul. 5, 2022

(54) HEADLIGHT APPARATUS

(71) Applicant: MAXELL, LTD., Kyoto (JP)

(72) Inventors: Toshinori Sugiyama, Kyoto (JP); Yasuhiko Kunii, Kyoto (JP); Masahiro Kishigami, Kyoto (JP)

(73) Assignee: MAXELL, LTD., Kyoto (JP)

( * ) Notice: Subject to any disclaimer, the term of this patent is extended or adjusted under 35 U.S.C. 154(b) by 0 days.

(21) Appl. No.: 17/262,270

(22) PCT Filed: May 17, 2019

(86) PCT No.: PCT/JP2019/019620
§ 371 (c)(1),
(2) Date: Jan. 22, 2021

(87) PCT Pub. No.: WO2020/021825
PCT Pub. Date: Jan. 30, 2020

(65) Prior Publication Data

US 2022/0003375 A1 Jan. 6, 2022

(30) Foreign Application Priority Data

Jul. 24, 2018 (JP) ..... JP2018-138602

(51) Int. Cl.
*F21S 41/24* (2018.01)
*F21S 41/27* (2018.01)
(Continued)

(52) U.S. Cl.
CPC ..... *F21S 41/24* (2018.01); *F21S 41/143* (2018.01); *F21S 41/27* (2018.01); *F21S 41/285* (2018.01);
(Continued)

(58) Field of Classification Search
CPC ..... F21S 41/24; F21S 41/27; F21S 41/322; F21S 41/143; F21S 41/285; F21W 2102/13
See application file for complete search history.

(56) References Cited

U.S. PATENT DOCUMENTS

2015/0103551 A1 4/2015 Tanaka
2016/0084462 A1 3/2016 Suwa et al.
(Continued)

FOREIGN PATENT DOCUMENTS

DE 102010046021 A1 3/2012
DE 102017112971 A1 * 12/2018 ..... F21S 41/24
(Continued)

OTHER PUBLICATIONS

A. Perrotin et al.,"Thin Lens Solutions for Lighting", ISAL 2017 Proceedings of the 12th International Symposium on Automotive Lightning, vol. 17, p. 155-164.
(Continued)

*Primary Examiner* — Erin Kryukova
(74) *Attorney, Agent, or Firm* — Mattingly & Malur, PC

(57) ABSTRACT

A headlight apparatus includes a high beam headlight and a low beam headlight, which includes: an LED; an LED collimator that is a light source condensing optical system configured to condense a light emitted from the LED; a light guide that is a light distribution controlling light guide, a light from the LED collimator entering the light guide; and a projector lens that a light from the light guide enters, the projector lens being configured to project a light. The light guide includes an incident surface, a plurality of total reflection surfaces, and an emission surface. A first light of an incident light from the incident surface is emitted from the emission surface without reaching the plurality of total reflection surfaces, and a second light of the incident light is
(Continued)

1 (1a): HEADLIGHT APPARATUS
10: LOW BEAM HEADLIGHT
20: HIGH BEAM HEADLIGHT
10a, 10b, 10c: LOW BEAM UNIT
20a, 20b: HIGH BEAM UNIT
11, 21: PROJECTOR LENS
13, 23: LED COLLIMATOR
14, 24: LIGHT GUIDE
32: LED SUBSTRATE emitted from the emission surface via multiple times of total reflection by the plurality of total reflection surfaces.

15 Claims, 16 Drawing Sheets

(51) Int. Cl.

| | |
|---|---|
| ***F21S 41/32*** | (2018.01) |
| ***F21S 41/143*** | (2018.01) |
| ***F21S 41/20*** | (2018.01) |
| ***F21S 45/48*** | (2018.01) |
| ***F21W 102/13*** | (2018.01) |

(52) U.S. Cl.
CPC ..... *F21S 41/322* (2018.01); *F21S 45/48* (2018.01); *F21W 2102/13* (2018.01)

(56) References Cited

U.S. PATENT DOCUMENTS

| | | | | |
|---|---|---|---|---|
| 2017/0030543 | A1* | 2/2017 | Gromfeld | F21S 41/27 |
| 2018/0087735 | A1* | 3/2018 | Joerg | F21S 41/27 |
| 2018/0187851 | A1* | 7/2018 | Hossfeld | F21S 41/40 |
| 2019/0017675 | A1* | 1/2019 | Suwa | F21S 41/143 |

FOREIGN PATENT DOCUMENTS

| | | | | |
|---|---|---|---|---|
| JP | 2015-076375 | A | | 4/2015 |
| JP | 2015-133170 | A | | 7/2015 |
| KR | 20150048353 | A | * | 5/2015 |
| KR | 20160079201 | A | | 7/2016 |
| WO | 2014/174843 | A1 | | 10/2014 |
| WO | 2018/084269 | A1 | | 5/2018 |

OTHER PUBLICATIONS

A. Perrotin et al., "Thin Lens Solutions for Lighting", ISAL 2017 Proceedings of the 12th International Symposium on Automotive Lightning, vol. 17, p. 155.

International Search Report of PCT/JP2019/019620 dated Aug. 6, 2019.

* cited by examiner (A)

(B)

1 (1a): HEADLIGHT APPARATUS
10: LOW BEAM HEADLIGHT
20: HIGH BEAM HEADLIGHT
10a, 10b, 10c: LOW BEAM UNIT
20a, 20b: HIGH BEAM UNIT
11, 21: PROJECTOR LENS
13, 23: LED COLLIMATOR
14, 24: LIGHT GUIDE
32: LED SUBSTRATE (A)

(B)

(A)

(B)

HEADLIGHT APPARATUS

TECHNICAL FIELD

The present invention relates to a technique for a headlight apparatus to be mounted on a vehicle.

BACKGROUND ART

A headlight apparatus for a vehicle includes a mechanism for emitting a low beam (that is, a headlight for passing each other) and a high beam (that is, a headlight for driving). The low beam is defined to be able to illuminate a road surface of 40 meters ahead. The high beam is defined to be able to illuminate a road surface of 100 meters ahead. In a case where there is an oncoming vehicle or the like, it is defined to use the low beam instead of the high beam in order to prevent a risk due to glare. A cutoff line for the low beam indicates a boundary line for cutting off and shielding an upper light of an illumination light.

A conventional headlight apparatus has a configuration in which a shade that is a light shielding component is provided, or a configuration in which a light source is disposed so that an optical axis of the light source is inclined as means for forming a cutoff line for a low beam, for example.

Further, in recent years, semiconductor light source devices such as a light emitting diode (LED) have been developed as solid light sources. Ones each using an LED as a light source have been developed for a headlight apparatus for a vehicle.

As an example of the conventional technique related to the headlight apparatus described above, there is Japanese Patent Application Publication No. 2015-133170 (Patent document 1). Patent document 1 describes that a headlight unit for a vehicle that can be reduced in weight and size and can suppress an influence of sunlight while ensuring an amount of light emitted from the headlight unit for the vehicle to the outside by a light emitting diode (LED) is provided.

Further, Non-Patent document 1 describes that height of 25 meter is realized as a head lamp for a vehicle by using an LED.

RELATED ART DOCUMENTS

Patent Documents

Patent document 1: Japanese Patent Application Publication No. 2015-133170

Non-Patent Documents

Non-Patent document 1: Thin Lens Solutions for Lighting, A. Perrotin, Valeo Lighting System, Angers, France, 12th International Symposium on Automotive Lightning —ISAL 2017—Proceedings of the Conference: Volume 17, p 155-158.

SUMMARY OF THE INVENTION

Problems to be Solved by the Invention

In a case where a shade that is a light shielding component is provided as means for forming a cutoff line for a low beam or in a case where a light source is disposed so that an optical axis of the light source is inclined, for example, the conventional headlight apparatus needs to have a thickness thicker than a certain level in a height direction of the headlight apparatus. For that reason, the conventional headlight apparatus has room for improvement in view of thinner. Further, for example, in a case where the conventional headlight apparatus is configured so that a light from the light source is shielded by the shade, light utilization is wasted due to the shielded light, and the conventional headlight apparatus also has room for improvement in view of the light utilization efficiency.

It is an object of the present invention to provide a technique capable of realizing a thinner thickness and improvement of light utilization in a case where a mechanism for emitting a low beam and a high beam is provided with respect to a technique for a headlight apparatus.

Means for Solving the Problem

A representative embodiment of the present invention is characterized by a headlight apparatus that has a configuration described below.

A headlight apparatus according to one embodiment is a headlight apparatus to be mounted on a vehicle. The headlight apparatus includes a low beam headlight configured to emit a low beam. The low beam headlight includes: a solid light source for the low beam; a light source condensing optical system for the low beam configured to condense a light emitted from the solid light source for the low beam, the light source condensing optical system for the low beam being disposed on an optical axis of the solid light source for the low beam; a light distribution controlling light guide for the low beam disposed on the optical axis, a light from the light source condensing optical system for the low beam entering the light distribution controlling light guide for the low beam, the light distribution controlling light guide for the low beam being configured to control light distribution thereof and emit a light; and a projector lens for the low beam disposed on the optical axis, the light from the light distribution controlling light guide for the low beam entering the projector lens for the low beam, the projector lens for the low beam being configured to project a light. The light distribution controlling light guide for the low beam includes: an incident surface that the light from the light source condensing optical system for the low beam enters; a plurality of total reflection surfaces; and an emission surface from which the light to the projector lens for the low beam is emitted. In this case, a first light of incident light from the incident surface is emitted from the emission surface without reaching the plurality of total reflection surfaces, and a second light of the incident light is emitted from the emission surface via multiple times of total reflection by the plurality of total reflection surfaces.

A headlight apparatus according to one embodiment is a headlight apparatus to be mounted on a vehicle. The headlight apparatus includes a high beam headlight configured to emit a high beam. The high beam headlight includes: a solid light source for the high beam; a light source condensing optical system for the high beam configured to condense a light emitted from the solid light source for the high beam, the light source condensing optical system for the high beam being disposed on an optical axis of the solid light source for the high beam; a light distribution controlling light guide for the high beam disposed on the optical axis, a light from the light source condensing optical system for the high beam entering the light distribution controlling light guide for the high beam, the light distribution controlling light guide for the high beam being configured to control light distribution thereof and emit a light; and a projector lens for the high beam disposed on the optical axis, the light from the light distribution controlling light guide for the high beam entering the projector lens for the high beam, the projector lens for the high beam being configured to project a light. The light distribution controlling light guide for the high beam include: an incident surface that the light from the light source condensing optical system for the high beam enters; and an emission surface from which the light to the projector lens for the high beam is emitted. In this case, at least one of the incident surface or the emission surface of the light distribution controlling light guide for the high beam has a vertically asymmetrical shape in the vertical direction on a sectional surface formed by a direction of the optical axis and the vertical direction.

Effects of the Invention

According to the representative embodiment of the present invention, it is possible to realize thin and improvement of light utilization efficiency with respect to a technique for a headlight apparatus in a case where a mechanism for emitting a low beam and a high beam is provided.

BRIEF DESCRIPTIONS OF THE DRAWINGS

DETAILED DESCRIPTION OF EMBODIMENTS

Figure 1:
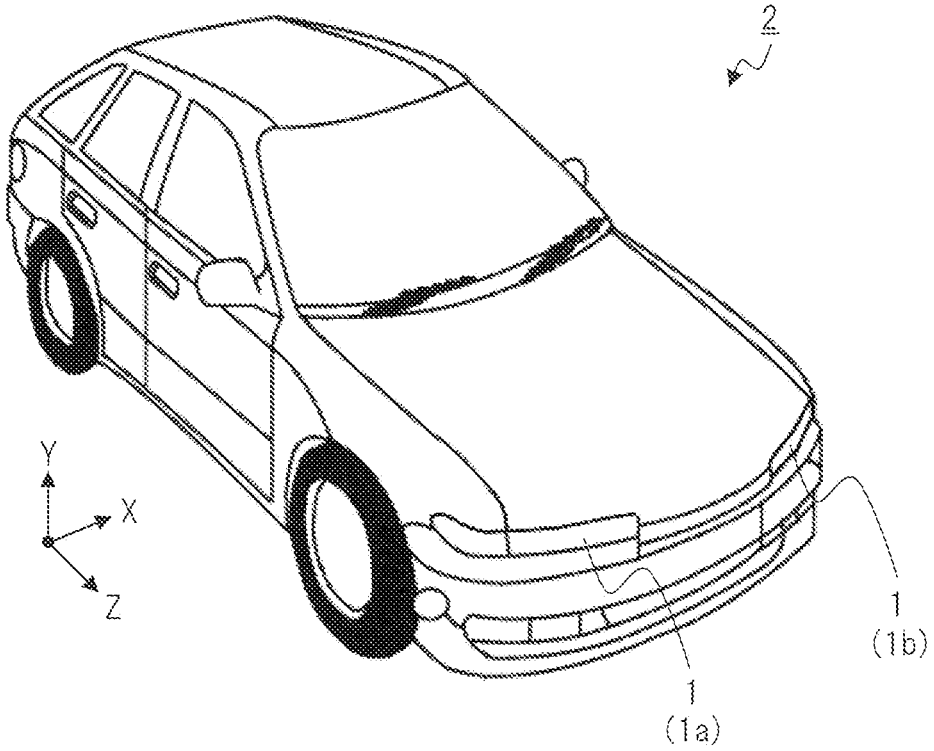
FIG. 1 is a view illustrating a configuration of a vehicle on which a headlight apparatus according to an embodiment of the present invention is mounted.
Figure 1:
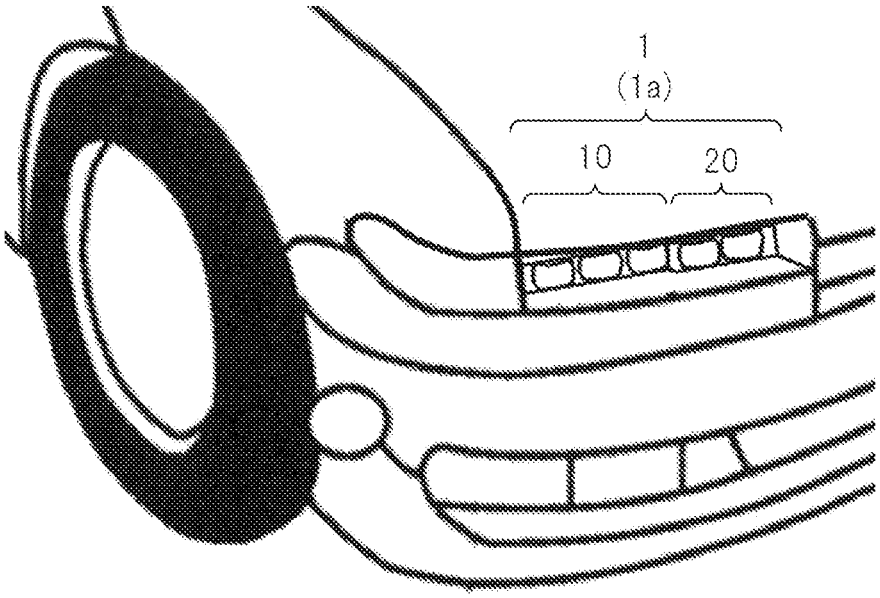

Hereinafter, an embodiment of the present invention will be described with reference to the drawings. Note that in all of the drawings for explaining the embodiment, the same reference numeral is generally assigned to the same unit, and its repeated explanation will be omitted.

Embodiment

A headlight apparatus according to an embodiment of the present invention will be described with reference to FIG. 1 to FIG. 20. The headlight apparatus according to the embodiment indicates a configuration in a case where LEDs are particularly used as a solid light source. By using the LEDs, it is possible to make the apparatus thinner and smaller. In that case, in order to realize the thinness of the whole apparatus, it is necessary to configure the apparatus so as to make components other the light LEDs thinner. For that reason, the headlight apparatus according to the embodiment does not adopt a configuration in which a shade that is a light shielding member is provided for a low beam emitting mechanism. The headlight apparatus according to the embodiment realizes thin and high light utilization efficiency by devising structures of a light source condensing optical system and a light distribution controlling light guide in addition to the LEDs. Specifically, the headlight apparatus according to the embodiment forms a low beam and a cutoff line thereof by using multiple times of total reflection inside the light guide.

[Vehicle and Headlight Apparatus]

FIG. 1 is a perspective view of an outline configuration of a vehicle 2 on which a headlight apparatus 1 according to the embodiment is mounted. (A) of FIG. 1 illustrates the headlight apparatus 1 (1*a*, 1*b*) respectively mounted at right and left positions of a front portion of the vehicle 2. The headlight apparatus 1 includes a headlight apparatus 1*a* provided at the right side of the front portion, and a headlight apparatus 1*b* provided at the left side of the front portion.

Note that an X direction, a Y direction, and a Z direction are indicated as directions for explanation. The X direction is a first horizontal direction, and corresponds to a lateral direction, a crosswise direction, or a width direction of the vehicle 2 or the headlight apparatus 1. The Y direction is a vertical direction, and corresponds to a height direction of the vehicle 2 or the headlight apparatus 1. The Z direction is a second horizontal direction, and corresponds to a front-back direction of the vehicle 2 or an optical axis direction of the headlight apparatus 1.

(B) of FIG. 1 illustrates an enlarged portion including the headlight apparatus 1*a* provided at the right side illustrated in (A). This headlight apparatus 1 (1*a*) is roughly classified into a low beam headlight 10 and a high beam headlight 20, by which the headlight apparatus 1 (1*a*) is configured. The low beam headlight 10 is a low beam emitting mechanism; is disposed at a position near the outside in the X direction of the front portion of the vehicle 2; and is configured by plural rows, for example, three rows of low beam units. The high beam headlight 20 is a high beam emitting mechanism; is disposed at a position near the inside in the X direction of the front portion of the vehicle 2; and is configured by plural rows, for example, two rows of high beam units.

Note that the headlight apparatus 1*b* provided at the left side has a similar configuration to that of the headlight apparatus 1*a* provided at the right side in a substantially symmetrical form. The headlight apparatuses 1 (1*a*, 1*b*) provided at the right and left sides have different light distributions from each other, which are substantially symmetrical in shape, and respectively have suitable light distributions. Specifically, although it will be described later, light distribution characteristics are designed so that the headlight apparatus 1 illuminates a roadside strip side more widely than an oncoming vehicle side on an optical axis of the headlight apparatus 1.

[Headlight Apparatus]

Figure 2:
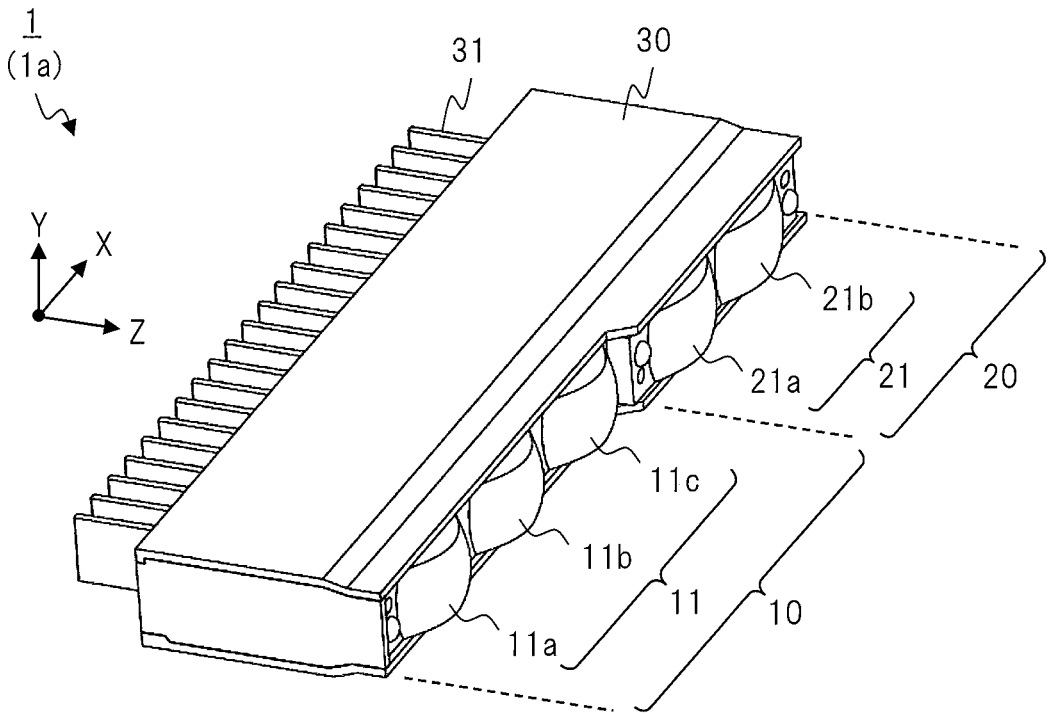
FIG. 2 is a perspective view illustrating a configuration of the whole of the headlight apparatus according to the embodiment.
Figure 3:
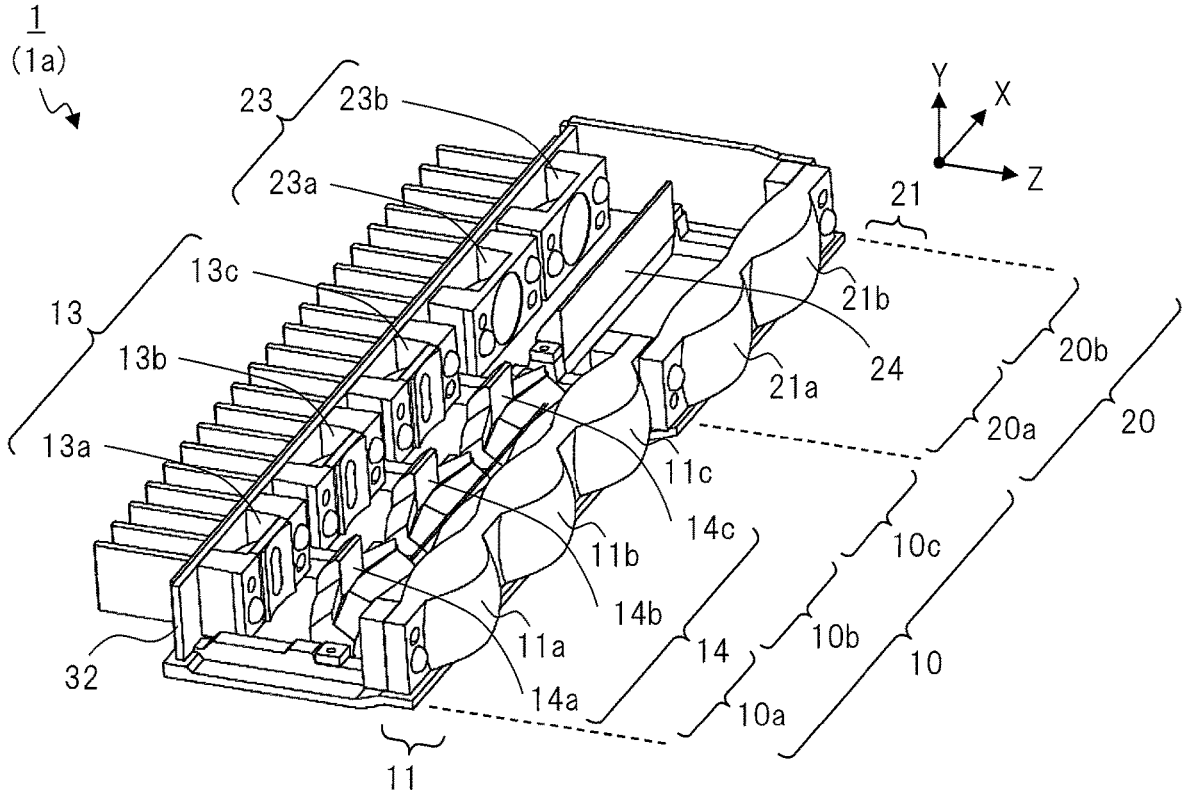
FIG. 3 is a perspective view illustrating a configuration of the inside of the headlight apparatus according to the embodiment.

FIG. 2 and FIG. 3 illustrate a perspective view of a configuration of the headlight apparatus 1 according to the embodiment (for example, the headlight apparatus 1*a* provided at the right side). FIG. 2 illustrates appearance of the whole headlight apparatus 1. FIG. 3 illustrates a configuration of the inside of the headlight apparatus 1.

In FIG. 2, the low beam headlight 10 and the high beam headlight 20, which are main ports of a main body of the headlight apparatus 1, are housed in a headlight case 30. A heat sinks 31 is fixed to a back side of the headlight case 30, that is, a rear side thereof in the Z direction that corresponds to light source sides of the low beam headlight 10 and the high beam headlight 20.

Aside surface of a front side of the headlight case 30 in the Z direction is opened, and respective projector lenses of the low beam headlight 10 and the high beam headlight 20 are disposed so as to be exposed. As a projector lens for low beam 11, three projector lenses 11*a*, 11*b*, and 11*c* are disposed in the X direction on the low beam headlight 10 side. As a projector lens for the high beam 21, two projector lenses 21*a* and 21*b* are disposed in the X direction on the high beam headlight 20 side.

In FIG. 3, the low beam headlight 10 is configured by three rows of low beam units 10*a*, 10*b*, and 10*c* in the X direction as three low beam units each of which has a similar structure to each other. The high beam headlight 20 is configured by two rows of high beam units 20*a* and 20*b* in the X direction as two high beam units each of which has a similar structure to each other.

Figure 4:
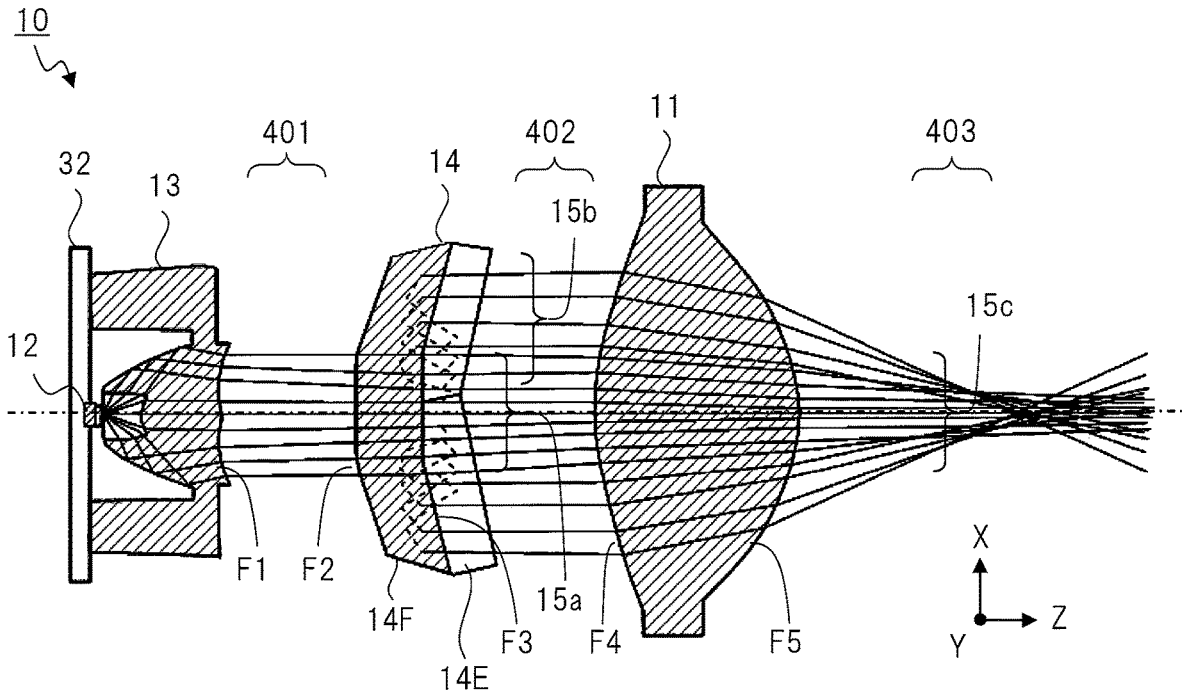
FIG. 4 is a view illustrating a horizontal section of a low beam headlight and a light path of a low beam in the headlight apparatus according to the embodiment.

An LED substrate 32 is fixed in the headlight case 30 so as to extend long in the X direction on an X-Y plane that is a side surface of the back side in the Z direction. The heat sink 31 is fixed to a surface of the LED substrate 32 that faces the rear side in the Z direction. The heat sink 31 has a plurality of fins, and dissipates heat of a plurality of LEDs. Although they are not visible in FIG. 3, as illustrated in FIG. 4 and the like, a plurality of LEDs (LED elements) is implemented as solid light sources on the X-Y plane that is a main surface of the LED substrate 32 and faces a front side in the Z direction. The plurality of LEDs is total five LEDs that correspond to five rows of beam emitting mechanisms (including the low beam units and the high beam units), and includes three LEDs for the low beam and two LEDs for the high beam. A circuit for controlling each of the plurality of LEDs to be turned on or off and the like are implemented on the LED substrate 32. Note that in the embodiment, plurality of LEDs is implemented on one LED substrate 32, but it may be configured so that plural pieces of LED substrates on each of which one or more LEDs are implemented are used. By using the LEDs, it is possible to realize the thin headlight apparatus 1 having low power consumption, a long life, a low cost, and excellent environmental protection.

LED collimators constituting a light source condensing optical system is disposed at positions of optical axes of the respective LEDs on the LED substrate 32 at the front side along the Z direction that is the optical axis direction. In the low beam headlight 10 side, three LED collimators 13*a*, 13*b*, and 13*c* are disposed in the X direction as an LED collimator 13 that is a light source condensing optical system for the low beam. In the high beam headlight 20 side, two LED collimators 23*a* and 23*b* are disposed in the X direction as LED collimators 23 that is a light source condensing optical system for the high beam.

A light source unit of the low beam headlight 10 in the headlight apparatus 1 according to the embodiment is configured by an LED for the low beam (an LED 12 illustrated in FIG. 4 and the like), which is a fixed light source for the low beam, and the LED collimator 13 that is a light source condensing optical system for the low beam. The LED collimator 13, which is the light source condensing optical system for the low beam, condenses a light emitted from the LED, and executes a predetermined light distribution control to emit the light. Similarly, a light source unit for the high beam headlight 20 is configured by an LED for the high beam (an LED 22 illustrated in FIG. 6 and the like), which is a fixed light source for the high beam, and the LED collimators 23 each of which is a light source condensing optical system for the high beam.

A light distribution controlling light guide is disposed at a predetermined position separated by a space of a predetermined distance at the front side in the Z direction with respect to each of the LED collimators. The low beam headlight 10 includes a light guide 14 that is a light distribution controlling light guide for the low beam. The light guide 14 includes three light guides 14*a*, 14*b*, and 14*c* that are disposed by three rows in the X direction. The high beam headlight 20 includes a light guide 24 that is a light distribution controlling light guide for the high beam. The light guide 24 is one light guide disposed by one row in the X direction. Each of the light guide 14 and the light guide 24 is fixed to the headlight case 30. The light guide 14 at the low beam is configured by three light distribution control lenses for the low beam, which are independently provided for the three rows of low beam units 10*a*, 10*b*, and 10*c*. The light guide 24 at the high beam is configured as one light distribution control lens for the high beam shared by two rows of high beam units 20*a* and 20*b*.

A projector lens is disposed at a predetermined position separated by a space of a predetermined distance at the front side in the Z direction with respect to each of the light guides. The projector lens for low beam 11 is disposed for the light guide 14 at the low beam side. The projector lens for the high beam 21 is disposed for the light guide 24 at the high beam side. Each of the projector lenses is fixed to the headlight case 30. The projector lenses 11 and 21 constitute a projection optical system that enlarges and projects illumination light to a space in front of the headlight apparatus 1, that is, the vehicle 2 together with a predetermined light distribution control.

In the embodiment, each of the projector lenses 11 and 21 of the low beam unit and the high beam unit is configured by one aspherical lens. This aspherical lens is configured by a biconvex lens that respectively has convex shapes on an incident side and an emission side toward the outside thereof, each of an incident surface and an emission surface is an aspherical surface.

Further, in particular, the projector lens for low beam 11 is configured as one component so that the three projector lenses 11*a*, 11*b*, and 11*c* of three rows of low beam units 10*a*, 10*b*, and 10*c* are connected in series in the X direction. The projector lens for the high beam 21 is configured as one component so that the two projector lenses 21*a* and 21*b* of the two rows of high beam units 20*a* and 20*b* are connected in series in the X direction. Each of the projector lenses is not limited to such a configuration, and can be any configuration.

The high beam headlight 20 realizes illumination of a road surface of 100 meters ahead, and the low beam headlight 10 realizes illumination of a road surface of 40 meters ahead. The low beam has light distribution in a direction slightly diagonally downward with respect to the optical axis in a horizontal direction (the Z direction).

In the embodiment, the low beam headlight 10 has a configuration in which a correspondence relation between the light source units (each including the LED and the LED collimator 13) and the light guides 14 is 3:3 in consideration of the amount of light, positioning accuracy, and the like. The low beam headlight 10 is not limited to this configuration, and can be any configuration. For example, the low beam headlight 10 may be configured so that the plurality (for example, three) of light guides 14 (14*a*, 14*b*, and 14*c*) is connected to each other in the X direction to form one part. For example, the low beam headlight 10 may be configured so that the plurality (for example, three) of LED collimators 13 (13*a*, 13*b*, and 13*c*) is connected to each other in the X direction to form one part.

In the embodiment, the high beam headlight 20 has a configuration in which a correspondence relation between the light source units (each including the LED and the LED collimator 23) and the light guide 24 is 2:1 in consideration of reduction of the number of parts. The high beam headlight 20 is not limited to this configuration, and can be any configuration. For example, the high beam headlight 20 may be configured so that the correspondence relation between the light source units and the light guides 24 is 2:2 as a plurality (for example, two) of independent light guides.

A configuration to control the headlight apparatus 1 is as follows. A predetermined controller (for example, an engine control unit) mounted on the vehicle 2 controls the headlight apparatus 1. When the high beam is turned on, the controller gives a control signal to the LED substrate 32 so as to turn on all five LEDs in the high beam headlight 20 and the low beam headlight 10 described above. The LED substrate 32 turns on the five LEDs in accordance with the control signal. Further, when the low beam is turned on, the controller gives a control signal to the LED substrate 32 so as to turn on the three LEDs at the low beam headlight 10 side and turn off the two LEDs at the high beam headlight 20 side. The LED substrate 32 turns on the three LEDs and turns off the two LEDs in accordance with the control signal. Note that as another control example, it is possible to turn on only the two LEDs at the high beam headlight 20 side, or to turn on or off the selected individual LEDs.

Note that in the headlight apparatus according to the embodiment, the plurality (for example, five) of LEDs, the plurality of low beam units, and the plurality of high beam unit are used in order to secure the amount of illumination. The number of LEDs, the number of low beam units and the number of high beam units are not limited those according to the embodiment, and each can be any number.

[Low Beam Headlight (1)]

FIG. 4 illustrates a configuration of a horizontal section (an X-Z plane) at a position of an optical axis (indicated by an alternate long and short dash line) of the LED, which corresponds to a case where the low beam headlight 10 and a light path are viewed from the above vertically (the Y direction). FIG. 4 illustrates a portion of one row of low beam unit in the X direction, but each row has the similar configuration. The LED 12 that is the LED for the low beam is implemented on the main surface of the LED substrate 32. The optical axis of the LED is a line perpendicular to a light emitting face (the X-Y plane) of the LED.

FIG. 4 illustrates an emission surface F1 of the LED collimator 13, an incident surface F2 and an emission surface F3 of the light guide 14, and an incident surface F4 and an emission surface F5 of the projector lens 11. Further, FIG. 4 illustrates a light 401, a light 402, and a light 403. The light 401 is a light emitted from the LED collimator 13, and is an incident light to the light guide 14. The light 402 is a light emitted from the light guide 14, and is an incident light to the projector lens 11. The light 403 is a light emitted from the projector lens 11. The light 402 that is the light emitted from the light guide 14 contains light fluxes (light fluxes for the low beam) 15*a* and 15*b*, which are indicated as a plurality of beams. The light 403 that is the light emitted from the projector lens 11 is a low beam configured by a light flux 15*c* for the low beam.

The light flux 15*a* indicates a light flux corresponding to a first light, which is a part of the light that does not pass through the total reflection inside the light guide 14 and is emitted as it is without being cut of the incident light to the incident surface F2 of the light guide 14 based on the light 401 and the light emitted from the emission surface F3. The light flux 15*b* indicates a light flux corresponding to a second light, which is the other part of the light that is reused while being cut via multiple times of total reflection inside the light guide 14 and is emitted of the incident light to the incident surface F2 of the light guide 14 based on the light 401 and the light emitted from the emission surface F3. In particular, the light flux 15*b* includes a light flux that is caused to move to the outside in the X direction due to the total reflection.

[Low Beam Headlight (2)]

Figure 5:
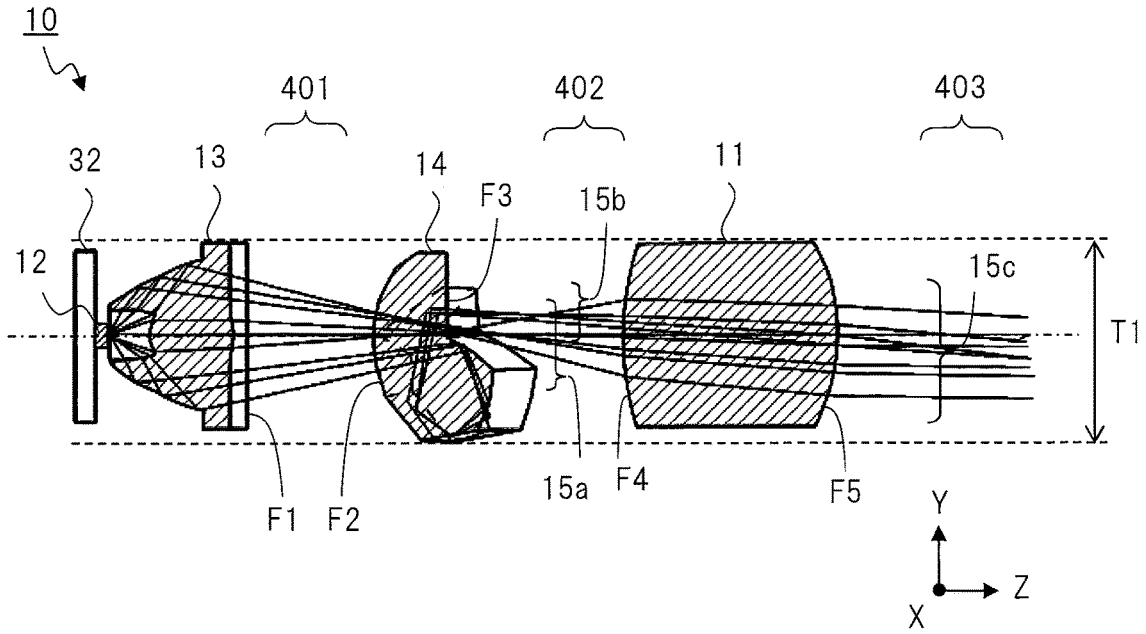
FIG. 5 is a view illustrating a vertical section of the low beam headlight and the light path of the low beam in the headlight apparatus according to the embodiment.

FIG. 5 illustrates a configuration of a vertical section (a Y-Z plane) at the position of the optical axis, which corresponds to a case where the low beam headlight 10 and the light path illustrated in FIG. 4 are viewed from the side thereof (the X direction). In FIG. 5, a thickness T1 in the Y direction indicates a thickness of the headlight apparatus 1 (the low beam headlight 10, in particular). This thickness T1 indicates a rough thickness corresponding to a range in which the LED substrate 32, the LED 12, the LED collimator 13, the light guide 14, and the projector lens 11, which are main components except for the headlight case 30 and parts such as screws, are accommodated. In the headlight apparatus 1 according to the embodiment, this thickness T1 can be reduced up to about 20 mm.

In FIG. 4 and FIG. 5, all light fluxes from the emission surface F1 of the LED collimator 13 enter the incident surface F2 of the light guide 14. All light fluxes from the emission surface F3 of the light guide 14 enter the incident surface F4 of the projector lens 11. So long as this condition is satisfied, a direction of the light emitted from the light guide 14 is not limited particularly. In FIG. 4, the light flux 15*c* for the low beam from the emission surface F5 of the projector lens 11 becomes a light flux that converges to a focal point due to a refraction action and then spreads in the X direction. In FIG. 5, the light fluxes from the emission surface F1 of the LED collimator 13 enters the incident surface F2 of the light guide 14 as a light flux narrowed down to the extent toward the optical axis in the Y direction, and travels toward the emission surface F3 or a total reflection surface. The light fluxes from the emission surface F3 of the light guide 14 enters the incident surface F4 of the projector lens 11 as an image inverted up and down in the Y direction. The light fluxes from the emission surface F5 of the projector lens 11 become the light flux 15*c* for the low beam that is directed slightly diagonally downward from the optical axis in the Y direction due to the refraction action.

[High Beam Headlight (1)]

Figure 6:
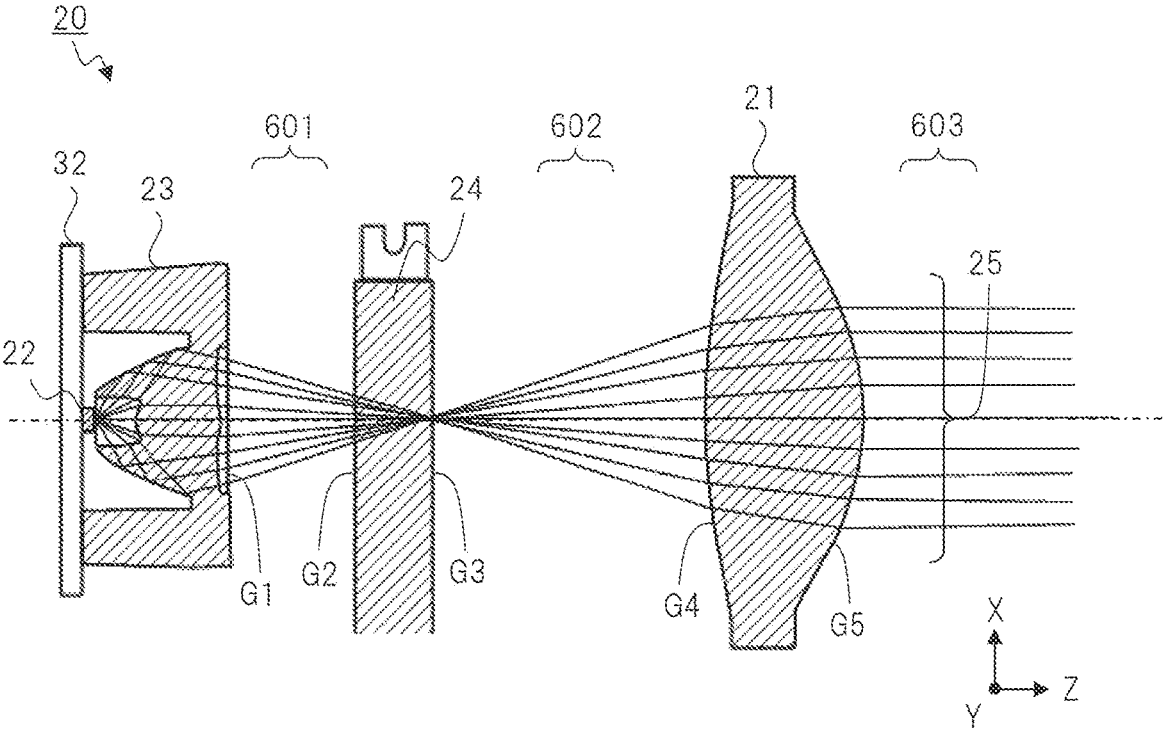
FIG. 6 is a view illustrating a horizontal section of a high beam headlight and a light path of a high beam in the headlight apparatus according to the embodiment.

FIG. 6 illustrates a configuration of a horizontal section (the X-Z plane) at a position of the optical axis (indicated by an alternate long and short dash line), which corresponds to a case where the high beam headlight 20 and a light path are viewed from the above vertically (the Y direction). FIG. 6 illustrates a portion of one row of high beam unit in the X direction, but each of rows has the similar configuration.

An LED 22 that is an LED for the high beam is implemented on the main surface of the LED substrate 32. Note that the same LED element may be used for the LED 12 that is the LED for the low beam and the LED 22 that is the LED for the high beam, or a different LED element may be used for each of the LED 12 and the LED 22.

FIG. 6 illustrates an emission surface G1 of the LED collimator 23, an incident surface G2 and an emission surface G3 of the light guide 24, and an incident surface G4 and an emission surface G5 of the projector lens 21. Further, FIG. 6 illustrates a light 601, a light 602, and a light 603. The light 601 is a light emitted from the emission surface G1 of the LED collimator 23, and is an incident light to the incident surface G2 of the light guide 24. The light 602 is a light emitted from the emission surface G3 of the light guide 24, and is an incident light to the incident surface G4 of the projector lens 21. The light 603 is a light emitted from the emission surface G5 of the projector lens 21. The light 603 is a high beam configured by a light flux 25 for the high beam.

[High Beam Headlight (2)]

Figure 7:
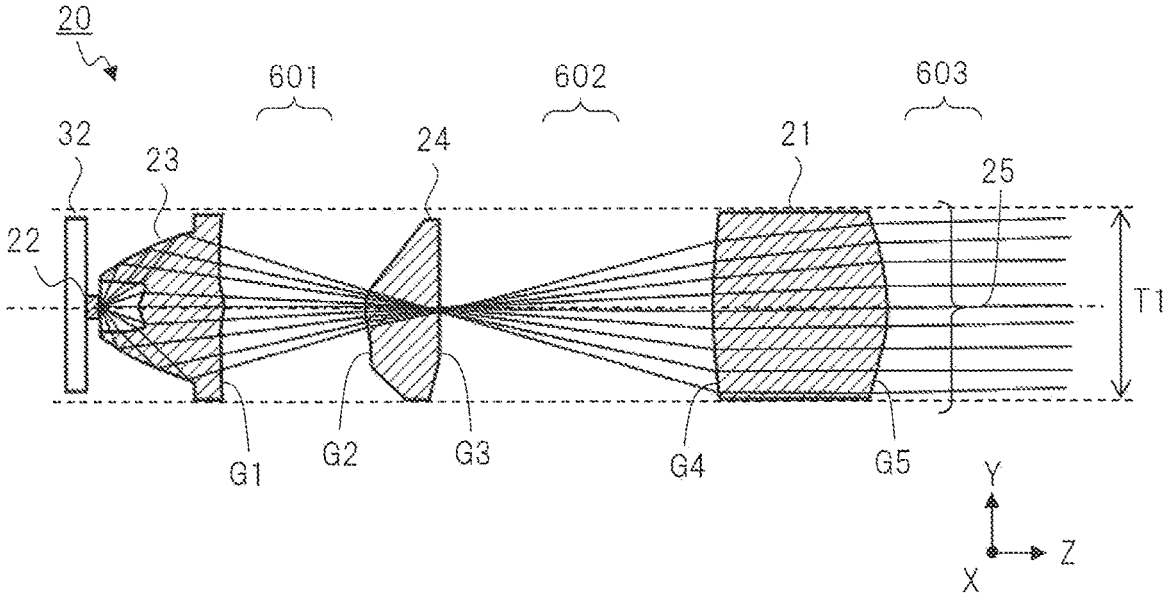
FIG. 7 is a view illustrating a vertical section of the high beam headlight and the light path of the high beam in the headlight apparatus according to the embodiment.

FIG. 7 illustrates a configuration of a vertical section (the Y-Z plane) at the position of the optical axis, which corresponds to a case where the high beam headlight 20 and the light path illustrated in FIG. 6 are viewed from the side thereof (the X direction). The LED substrate 32, the LED 22, the LED collimator 23, the light guide 24, and the projector lens 21, which are main components of the high beam headlight 20, are accommodated within a range of the thickness T1 in the Y direction. The thickness T1 at the high beam headlight 20 side illustrated in FIG. 7 is the same as the thickness T1 at the low beam headlight 10 side illustrated in FIG. 5.

In FIG. 6 and FIG. 7, all light fluxes from the emission surface G1 of the LED collimator 23 enter the incident surface G2 of the light guide 24. Almost of light fluxes from the emission surface G3 of the light guide 24 enters the incident surface G4 of the projector lens 21. Light fluxes from the emission surface G1 of the LED collimator 23 enter the incident surface G2 of the light guide 24 as a light flux narrowed down to the extent toward the optical axis in the X direction and the Y direction. In FIG. 7, the light fluxes from the emission surface G3 of the light guide 24 enter the incident surface G4 of the projector lens 21 as an image inverted up and down in the Y direction. The light fluxes from the emission surface G5 of the projector lens 21 become the light flux 25 for the high beam that is a substantially parallel light along the direction of the optical axis (the Z direction).

[Light Source Condensing Optical System for Low Beam (1)]

Figure 8:
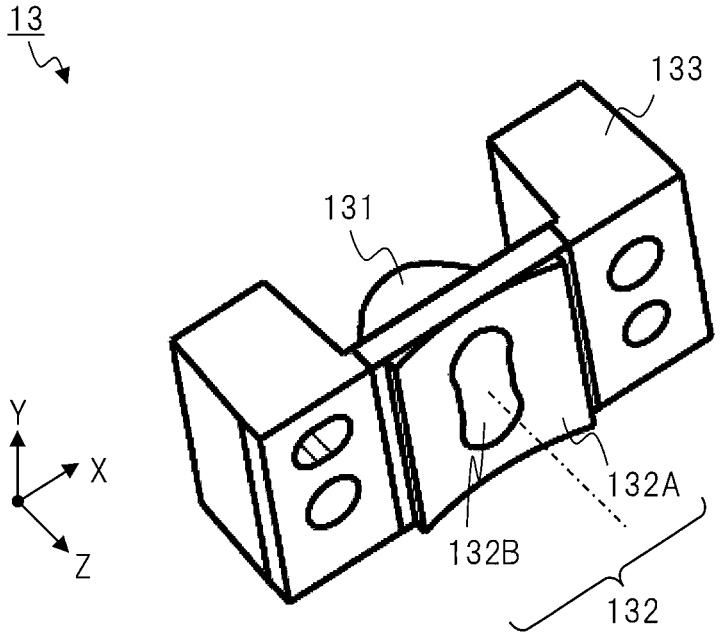
FIG. 8 is a perspective view illustrating a configuration of a light source condensing optical system for the low beam in the headlight apparatus according to the embodiment.

FIG. 8 illustrates a perspective view of a configuration of the LED collimator 13 that is a light source condensing optical system for the low beam in the low beam headlight 10. As an outline of functions thereof, the LED collimator 13 has a function to condense the light from the LED 12 and convert the light into a light substantially parallel to the road surface of the vehicle 2 (the corresponding Z direction). Specifically, as illustrated in FIG. 4 and FIG. 5, the light emitted from the LED collimator 13 is a light that is condensed so as to be narrowed down to the incident surface F2 of the light guide 14 to the extent.

The LED collimator 13 includes an incident side element 131, an emission side element 132, and installation units 133. Each of the installation units 133 is a unit for positioning and mounting the LED collimator 13 with respect to the LED 12 (FIG. 4) of the LED substrate 32 so as to be fixed to the main surface of the LED substrate 32. The installation units 133 respectively have screw holes, for example, and are provided at both sides of the incident side element 131 and the emission side element 132 in the X direction.

The incident side element 131 has a substantially conical shape (see FIG. 10, which will be described in detail later). As illustrated in FIG. 4 and the like, the incident side element 131 is disposed so as to face a light emitting face of the LED 12 on the optical axis of the LED 12.

The emission side element 132 has a refractive element 132A and a refractive element 132B. The refractive element 132A is arranged in an area including a bottom surface of a cone of the incident side element 131. The refractive element 132B is arranged at a central portion corresponding to the optical axis. The refractive element 132B is integrally formed at the central portion of the refractive element 132A. The emission side element 132 can be configured as a lens structure by integrally molding.

As illustrated in FIG. 4 and FIG. 5, the refractive element 132B provided at the central portion is configured as a convex lens having a convex shape at the front side in the Z direction in order to strengthen light distribution of the central portion in the vicinity of the optical axis.

As illustrated in FIG. 4 and FIG. 5, the refractive element 132A provided at an outer circumferential side has a cylinder shape, and is configured as a concave lens (in other words, a cylindrical lens) having a concave shape in the front side in the Z direction. This cylinder shape is a columnar surface shape corresponding to a one-dimensional curved surface, which has a curved line (with a different curvature) in the X direction, and has a straight line in the Y direction.

As illustrated in FIG. 4 and FIG. 5, the light fluxes of the light (the light 401) emitted from the emission side element 132 of the LED collimator 13 have predetermined light distribution in which narrowing in the Y direction is stronger than narrowing in the X direction. As a result, the light fluxes of the incident light to the light guide 14 by the light emitted from the LED collimator 13 become a horizontally (the X direction) long elliptical shape (an area 1101 illustrated in FIG. 11, which will be described later) at a position of the incident surface F2. In this design of the light distribution, the light fluxes of the incident light to the light guide 14 is narrowed down to a narrower area compared with the light fluxed of the light emitted from the LED collimator 13.

[Light Source Condensing Optical System for High Beam (1)]

Figure 9:
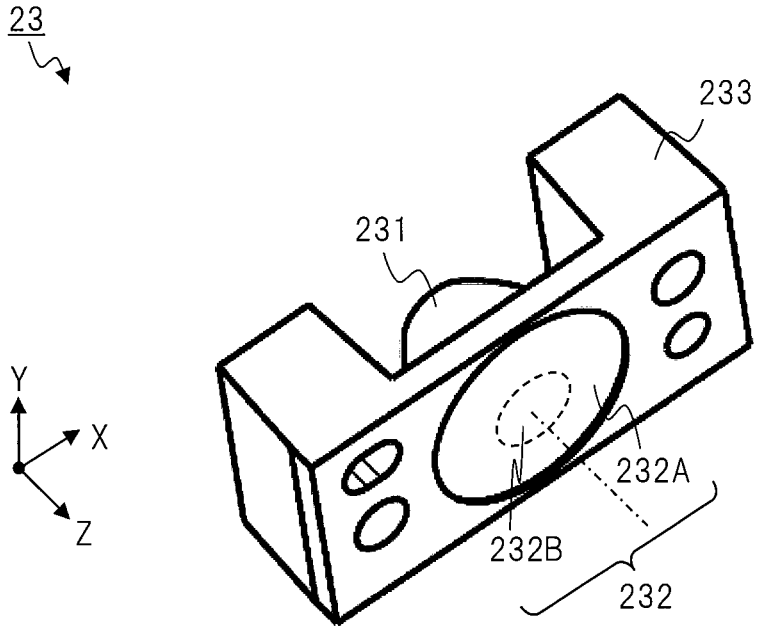
FIG. 9 is a perspective view illustrating a configuration of a light source condensing optical system for the high beam in the headlight apparatus according to the embodiment.

FIG. 9 illustrates a perspective view of a configuration of the LED collimator 23 that is a light source condensing optical system for the high beam in the high beam headlight 20. As an outline of functions thereof, the LED collimator 23 has a function to condense the light from the LED 22 and convert the light into a condensed light so as to be narrowed down to the extent toward the optical axis in the Y direction with respect to the light guide 24 as illustrated in FIG. 6 and FIG. 7.

The LED collimator 23 includes an incident side element 231, an emission side element 232, and installation units 233. As well as the installation units 133, each of the installation units 233 is a unit for positioning and mounting the LED collimator 23 with respect to the LED 22 (FIG. 6) of the LED substrate 32 so as to be fixed to the main surface of the LED substrate 32.

Similarly, the incident side element 231 has a substantially conical shape. As illustrated in FIG. 6 and the like, the incident side element 231 is disposed so as to face a light emitting face of the LED 22 on the optical axis of the LED 22.

The emission side element 232 has a refractive element 232A and a refractive element 232B. The refractive element 232A is arranged in an area including a bottom surface of a cone of the incident side element 231. The refractive element 232B is arranged at a central portion corresponding to the optical axis. The refractive element 232B is integrally formed at the central portion of the refractive element 232A. The emission side element 232 can be configured as a lens structure by integrally molding.

As illustrated in FIG. 6 and FIG. 7, the refractive element 232B provided at the central portion is configured as a convex lens having a convex shape at the front side in the Z direction in order to strengthen light distribution of the central portion in the vicinity of the optical axis.

As illustrated in FIG. 6 and FIG. 7, the refractive element 232A provided at an outer circumferential side has a substantially planar shape, and is configured as a flat lens.

As illustrated in FIG. 6 and FIG. 7, the light fluxes of the light (the light 601) emitted from the emission side element 232 of the LED collimator 23 have predetermined light distribution in which narrowing in the Y direction is stronger than narrowing in the X direction. As a result, the light fluxes of the incident light to the light guide 24 by the light emitted from the LED collimator 23 become a horizontally (the X direction) long elliptical shape (an area 1601 illustrated in FIG. 16, which will be described later) at a position of the incident surface G2. In this design of the light distribution, the light fluxes of the incident light to the light guide 24 is narrowed down to a narrower area compared with the light fluxed of the light emitted from the LED collimator 23.

[Light Source Condensing Optical System for Low Beam (2)]

Figure 10:
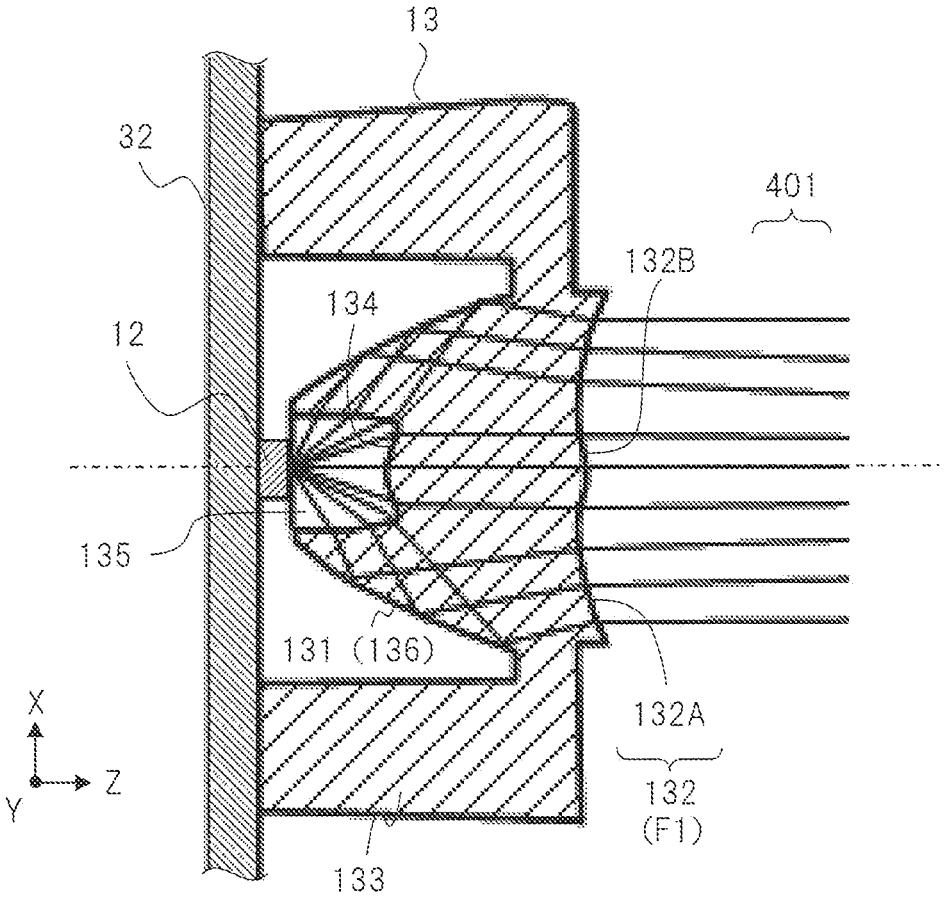
FIG. 10 is a view illustrating a horizontal section of the light source condensing optical system for the low beam and the light path in the headlight apparatus according to the embodiment.

FIG. 10 illustrates a horizontal section (the X-Z plane) and a light path of the LED collimator 13 illustrated in FIG. 8.

Specifically, the incident side element 131 includes a concave portion 135 and a refractive element 134 provided on an incident side, and a side surface reflector 136. The concave portion 135 and the refractive element 134 are disposed so as to face the light emitting face of the LED 12 on the optical axis of the LED 12. An opening surface of the concave portion 135 is disposed at a position of the light emitting face of the LED 12. The refractive element 134 is formed in a bottom surface of the concave portion 135. The refractive element 134 is configured as a convex lens that has a convex shape at the incident side.

The side surface reflector 136 has a paraboloidal surface obtained by rotating a sectional surface of a substantially parabola around the optical axis. The light is totally reflected on the paraboloidal surface inside the side surface reflector 136. The light emitted from the light emitting face of the LED 12 has light distribution in which the light is emitted in each direction around the optical axis by using the optical axis as the center. The paraboloidal surface of the side surface reflector 136 is designed within a range of an angle that allows total reflection of the light thereof in each direction.

A part of the light emitted from the LED 12 enters the refractive element 134 in the concave portion 135 to undergo a refraction action, thereby becoming a substantially parallel light to go toward the refractive element 132B provided at the central portion of the emission side element 132, in particular. The light transmits the refractive element 132B to undergo a refraction action, and is emitted toward the optical axis as a light flux that is narrowed down to the extent.

The other part of the light emitted from the LED 12 transmits a side surface of the concave portion 135 to travel to the side surface reflector 136, and is totally reflected by the paraboloidal surface to go toward the emission side element 132. At that time, the total reflection by the paraboloidal surface causes the light to be narrowed down toward the optical axis in the X direction and the Y direction. The light transmits the refractive element 132A provided at the outer circumference, in particular, to undergo the refraction action, and is emitted as a substantially parallel light flux in the X direction as illustrated in FIG. 4, and a light flux narrowed down toward the optical axis in the Y direction as illustrated in FIG. 5.

The LED collimator 23 provided at the high beam side has a configuration of the incident side that is similar to the configuration of the LED collimator 13 provided at the low beam.

The LED collimators 13 and 23 can be manufactured by a general molding processing method using a resin material having visible light transmittance and heat resistance, such as polycarbonate (PC) or silicone, for example.

As described above, in the embodiment, the LED collimators 13 and 23 allow the light emitted from the LEDs 12 and 22 to be to be extracted efficiently and used. Note that the headlight apparatus 1 according to the embodiment is configured so as to use the plurality of the LED collimators 13 and 23 independent for each row, but the configuration thereof is not limited to such a configuration, and can be any configuration. A configuration in which a plurality of LED collimators 13 is integrated into one structure, and a configuration in which a plurality of LED collimators 23 is integrated into one structure are also possible. A configuration of the light distribution of the light emitted from the LED collimators 13 and 23 is not limited to the configuration described above, and can be any configuration.

[Light Distribution Control Light Guide for Low Beam (1)]

Figure 11:
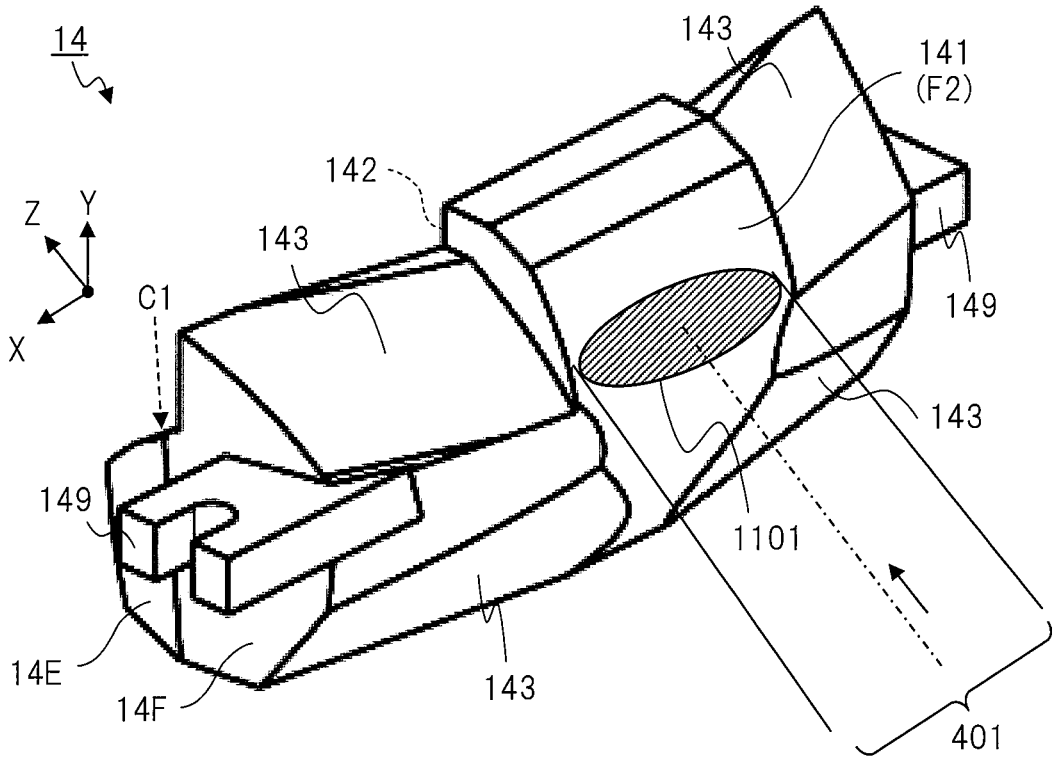
FIG. 11 is a perspective view illustrating a configuration of an incident side of a light distribution controlling light guide for the low beam in the headlight apparatus according to the embodiment.
Figure 12:
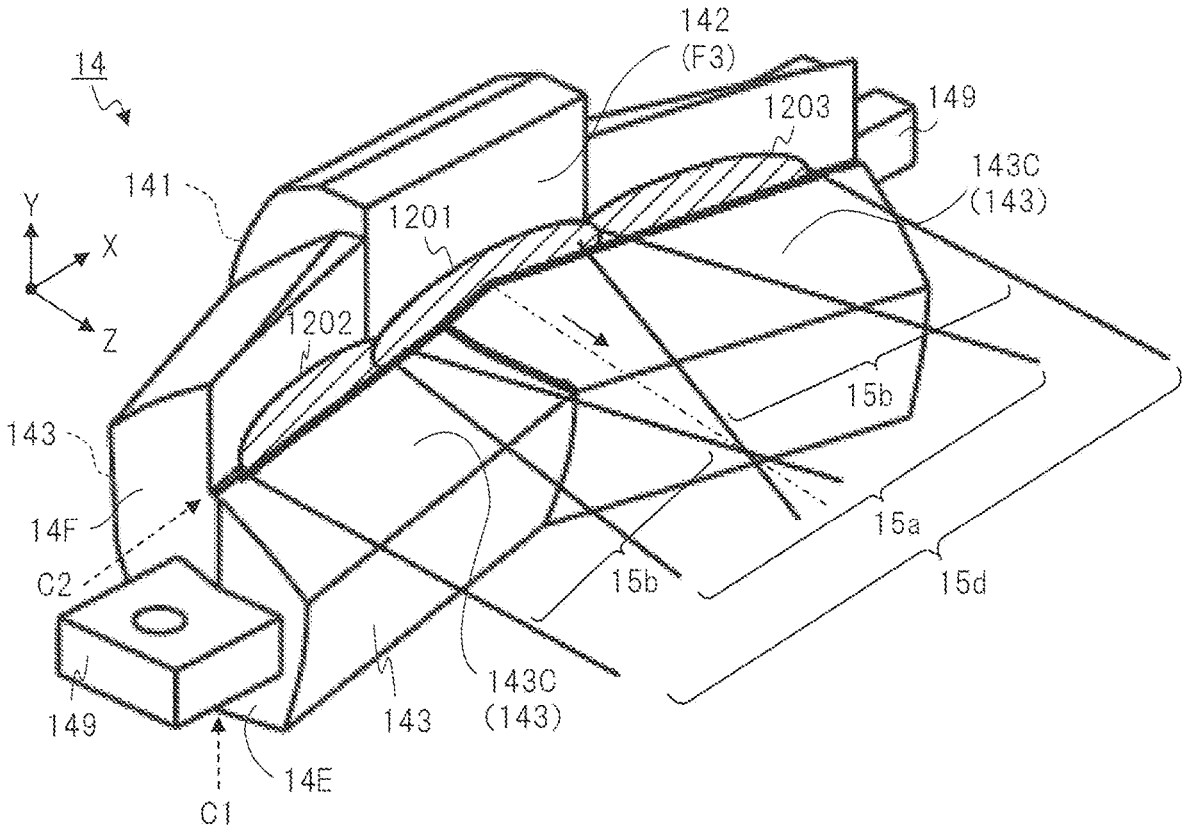
FIG. 12 is a perspective view illustrating a configuration of an emission side of the light distribution controlling light guide for the low beam in the headlight apparatus according to the embodiment.
Figure 13:
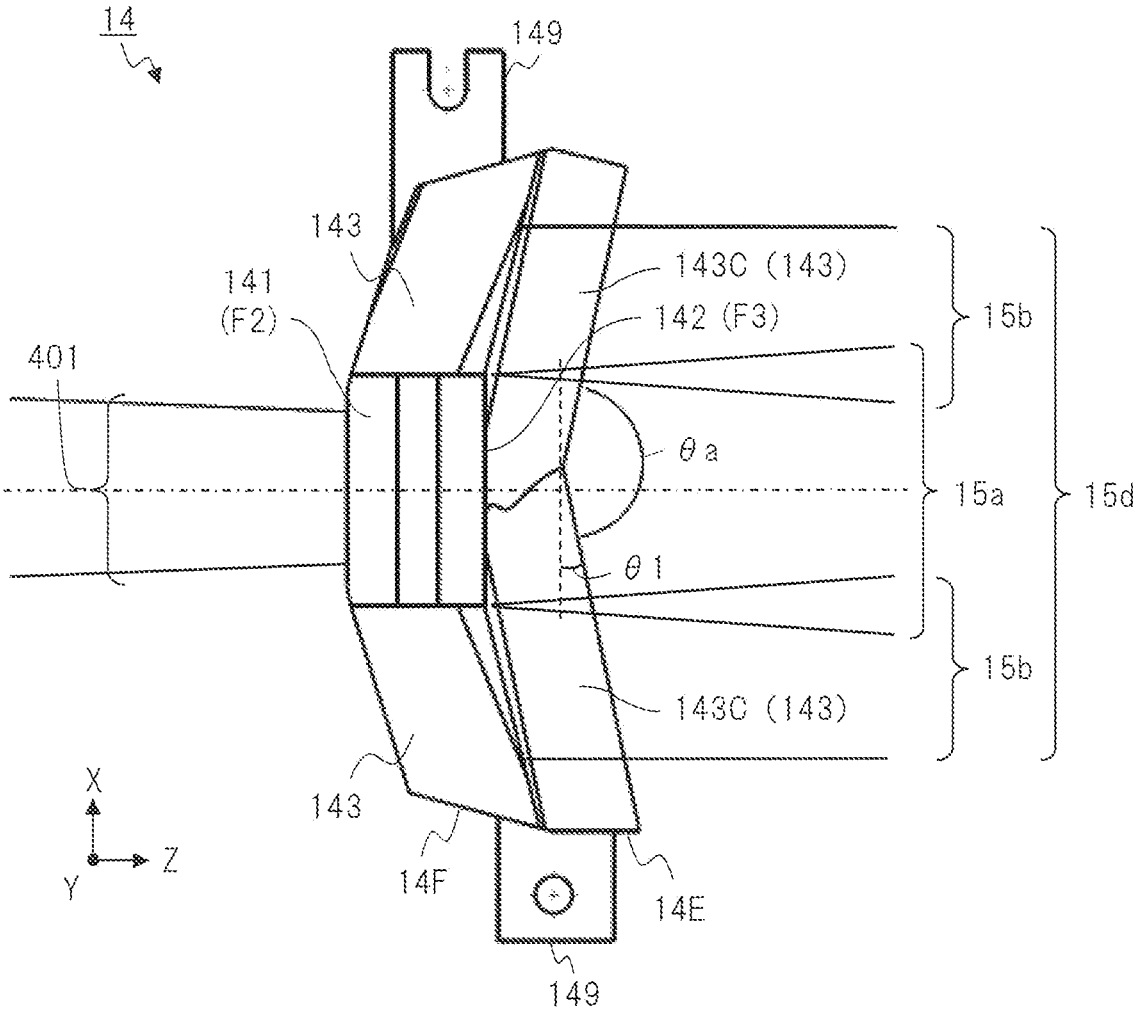
FIG. 13 is a top view of the light distribution controlling light guide for the low beam in the headlight apparatus according to the embodiment.
Figure 14:
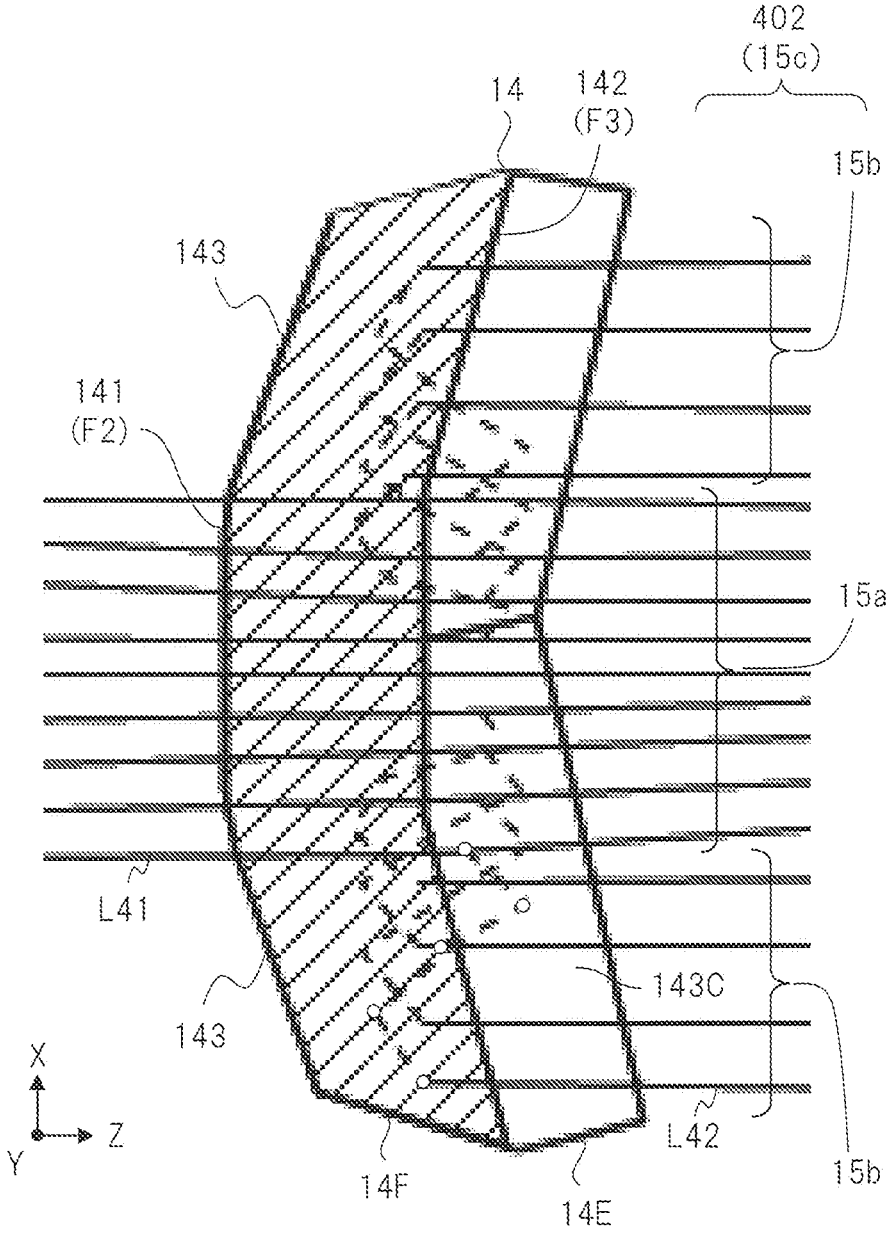
FIG. 14 is a view illustrating a horizontal section of the light distribution controlling light guide for the low beam and a light path in the headlight apparatus according to the embodiment.
Figure 15:
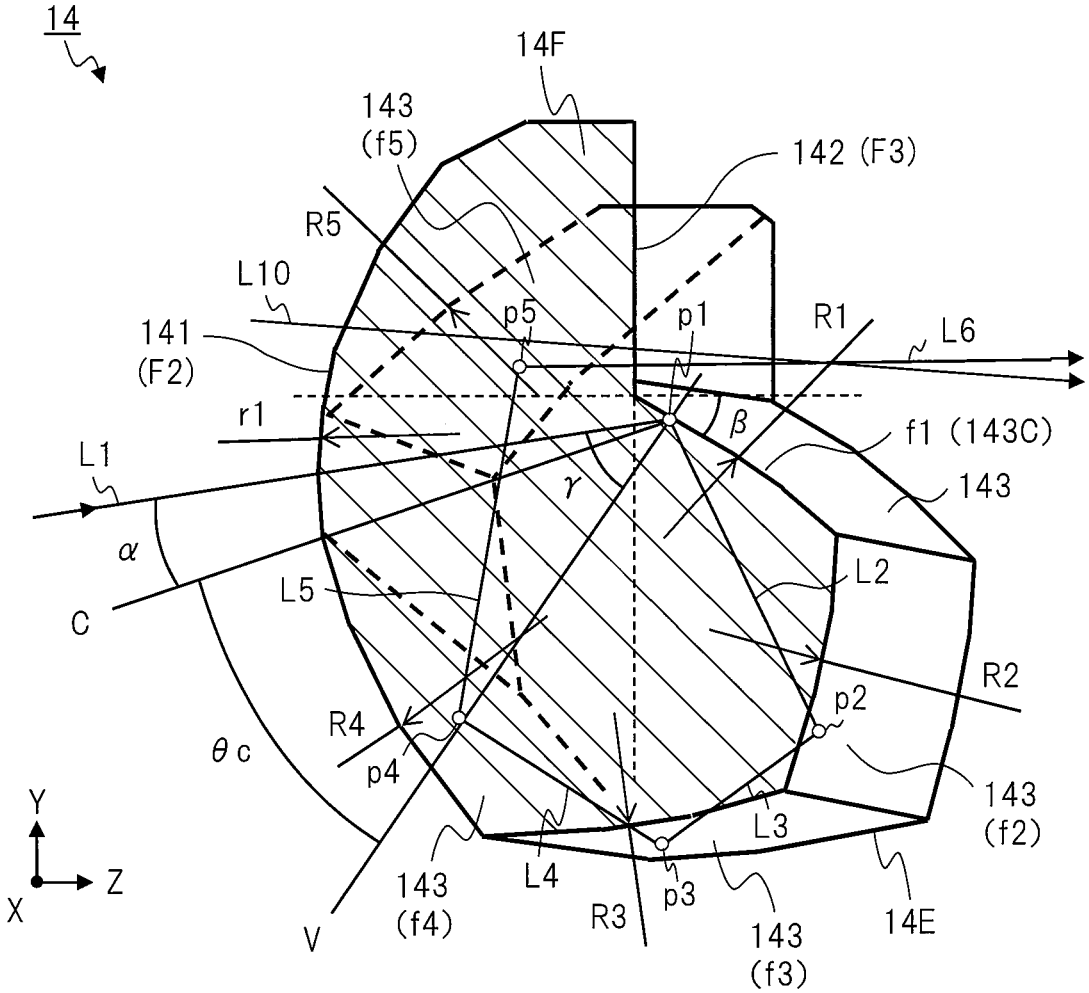
FIG. 15 is a view illustrating a vertical section of the light distribution controlling light guide for the low beam and the light path in the headlight apparatus according to the embodiment.

A configuration of the light guide 14, which is the light distribution controlling light guide for the low beam in the low beam headlight 10, will be described with reference to FIG. 11 to FIG. 15. FIG. 11 illustrates a perspective view of the configuration of the light guide 14 that is the light distribution controlling light guide for the low beam. FIG. 11 illustrates a perspective view when the incident surface F2 is viewed from the rear side in the Z direction (the LED collimator 13 side). FIG. 12 illustrates a perspective view regarding the light guide 14 illustrated in FIG. 11 when the emission surface F3 is viewed from the front side in the Z direction (the projector lens 11 side). FIG. 13 illustrates a top view (the X-Z plane) when the light guide 14 is viewed from the above in the Y direction in a planar view. FIG. 14 illustrates an example of a horizontal section and beams at an optical axis position of the light guide 14. FIG. 15 illustrates a configuration of the total reflection by the vertical section (the Y-Z plane) of the light guide 14.

In FIG. 11, the light guide 14 includes an incident unit 141, an emission unit 142, total reflection units 143, installation units 149, and the like. Further, in the present embodiment, the light guide 14 is roughly classified into a first light guide unit 14F and a second light guide unit 14E. With respect to a reference line C1, the light guide 14 has the first light guide unit 14F at the rear side in the Z direction, and has the second light guide unit 14E at the front side in the Z direction. The first light guide unit 14F and the second light guide unit 14E correspond to configuration examples of members in a case where the light guide 14 is manufactured by injection molding. Depending upon a shape of each of the members and the design of an index of refraction thereof, a plurality of total reflection surfaces is formed inside the light guide 14 as illustrated in FIG. 15. Each of the total reflection surfaces is formed at a boundary of the member of the light guide 14 (resin, which will be described later) and the outside air due to a difference the indices of refraction between the member and the air.

In FIG. 11, the light guide 14 has the incident unit 141 at the rear side in the Z direction in the vicinity of the optical axis in the X direction, and respectively has the total reflection units 143 at both right and left sides in the X direction with respect to the incident unit 141. Each of the right and left total reflection units 143 further has the total reflection units 143 at upper and lower positions in the Y direction, respectively. The installation units 149 are respectively provided at both outer sides with respect to the right and left total reflection units 143. As illustrated in FIG. 3, each of the installation units 149 is a part for positioning and fixing the light guide 14 with the other light guides 14 or the light guide 24, and the headlight case 30, which are disposed next to each other in the X direction, and has a screw hole, for example.

The incident unit 141 has the incident surface F2 in the vicinity of the optical axis indicated by an alternate long and short dash line. The incident surface F2 has a substantially planar shape (FIG. 14) in the X direction, and a curved surface shape (FIG. 15) in the Y direction.

On the incident surface F2, an area 1101 is an area that has a horizontally long elliptical shape into which the incident light (the light 401) enters. Like the area 1101, a light flux of the incident light (the light 401) to the incident surface F2 of the light guide 14 has light distribution of an elliptical shape that is relatively horizontally long (the X direction). This light distribution is designed in such a manner in order to have a horizontally wide characteristic ((A) of FIG. 20, which will be described later) as light distribution characteristics of the low beam.

[Light Distribution Control Light Guide for Low Beam (2)]

In FIG. 12, the light guide 14 has the emission unit 142 in a horizontally long area including a center, right and left in the X direction at an upper portion in the Y direction (a portion of an upper side with respect to a reference line C2 and the second light guide unit 14E). The emission unit 142 has the emission surface F3 in the area. As illustrated in FIG. 13, the emission surface F3 has a flat surface parallel to the X direction in a central area in the X direction (referred to as a "first emission surface"), which is provided at the opposite side of the incident unit 141, and respectively has oblique flat surfaces that face the optical axis in areas at right and left sides (referred to as a "second emission surface" and a "third emission surface").

The second light guide unit 14E is provided at a lower side in the Y direction with respect to the emission surface F3 and the reference line C2 in a shape that protrudes toward the front side in the Z direction. The second light guide unit 14E has the total reflection unit 143, and in particular, a first total reflection surface (the cutoff surface 143C), a second total reflection surface, and a third total reflection surface are formed (total reflection surfaces f1 to f3 illustrated in FIG. 15). The first light guide unit 14F includes the incident surface F2 and the emission surface F3, and in particular, a fourth total reflection surface and a fifth total reflection surface are formed in the total reflection unit 143 (total reflection surfaces f4 and f5 illustrated in FIG. 15). Note that more specifically, the second light guide unit 14E is configured by two parts on the right and left in the X direction as parts by the injection molding.

The emission surface F3 has an area (a first emission area) 1201 regarding the emitted light in the central area (the first emission surface). This area 1201 has a semi-elliptical shape obtained by cutting an area at a lower side from the reference line C2 from a horizontally (the X direction) long ellipse, in other words, a semi-elliptical shape that has an arc at an upper side and a string at the lower side. This area 1201 is an area where the first light of an incident light to the incident surface F2 that does not pass through the total reflection is mainly emitted.

Further, in the emission surface F3, with respect to the central area (the first emission surface), an area regarding the emitted light (a second emission area) 1202 is provided in an area at the right side in the X direction (the second emission surface), and an area regarding the emitted light (a third emission area) 1203 is provided in an area at the left side thereof (the third emission surface). Similarly, each of these areas 1202 and 1203 has a semi-elliptical shape obtained by cutting an area at a lower side. These areas 1202 and 1203 are areas where the second light of the incident light to the incident surface F2 is mainly emitted via the total reflection. The second light is emitted from these areas 1202 and 1203 so as to be reused via multiple times of total reflection by the plurality of total reflection surfaces inside the light guide 14. The second light is converted into a light that travels outward in the X direction with the multiple times of total reflection even though the light is a light that enters the central area (FIG. 14).

Further, FIG. 12 illustrates the light flux 15*a* for the low beam corresponding to the light emitted from the area 1201 and the light flux 15*b* for the low beam corresponding to the light emitted from the areas 1202 and 1203. A light flux 15*d* for the low beam corresponds to the overall emission light (the light 402) from the emission surface F3 of the light guide 14, which is a combination of the light flux 15*a* for the low beam and the light flux 15*b* for the low beam, and has light distribution that is wide in the X direction.

The cutoff surface 143C is formed as a sloop at the lower side in the Y direction so as to be adjacent to the emission surface F3 (including the areas 1201, 1202, and 1203) of the emission unit 142. The cutoff surface 143C is a component for forming a cutoff line of the low beam. The first light that travels toward the emission surface F3 of the incident light is emitted from the emission surface F3 (the areas 1201, 1202, and 1203) as it is without undergoing total reflection, and becomes the light flux 15*a* for the low beam. The second light that does not travel to the emission surface F3 but travels toward the cutoff surface 143C (the first total reflection surface) of the incident light is totally reflected by the cutoff surface 143C for the first time, and travels toward the second total reflection surface. The second light then repeats total reflection by each of the plurality of total reflection surfaces (the second total reflection surface to the fifth total reflection surface) inside the light guide 14 to reach the emission surface F3 that is provided at an upper side in the Y direction, and is emitted from the emission surface F3 (the areas 1201, 1202, and 1203).

[Light Distribution Control Light Guide for Low Beam (3)]

FIG. 13 illustrates that the total reflection surface of each of the total reflection units 143 is formed as a sloop that faces the optical axis in a top view (the X-Z plane) corresponding to FIG. 12 and the like. As illustrated in FIG. 14, in the light guide 14, the plurality of total reflection surfaces of the plurality of total reflection units 143 is designed so that an emission position on the emission surface F3 is shifted outward in the X direction with respect to an incident position on the incident surface F2 due to the total reflection of the second light. Specifically, as illustrated in FIG. 13, the plurality of total reflection surfaces including the cutoff surface 143C (the first total reflection surface) is disposed with a relationship to be curved by an angle θ1 of about 10° to 15° with respect to the central flat surface (the first emission surface) of the emission surface F3 by using the optical axis as an axis of symmetry. As a result, a right and left opening/closing angle θa in the total reflection unit 143 (the cutoff surface 143C and the like) of the second light guide unit 14E at a lower side of the emission surface F3 when viewed from the X-Z plane is about 150° to 160°. As a result, the wide light flux 15*d* for the low beam in the X direction is realized while reusing the incident light by the total reflection.

[Light Distribution Control Light Guide for Low Beam (4)]

In FIG. 14, the second light of the incident light to the incident surface F2 of the incident unit 141, for example, a beam L41 moves outward in the X direction (for example, a right side) due to multiple times of total reflection (indicated by broken lines and points) by the plurality of total reflection surface inside the light guide 14, and becomes a beam L42. The beam L42 is emitted forward in the Z direction from the emission surface F3 of the emission unit 142 (in particular, the area 1202 at the right side in FIG. 12) as a part of the light flux 15*b* for the low beam.

[Light Distribution Control Light Guide for Low Beam (5)]

FIG. 15 illustrates a vertical section at the first total reflection surface (the cutoff surface 143C) that corresponds to the optical axis position in the light guide 14. As illustrated in FIG. 15, the light guide 14 has a polyhedron shape including a plurality of total reflection surfaces inside thereof. In the embodiment, the light guide 14 includes the five total reflection surfaces f1 to f5 as the plurality of total reflection surfaces.

The incident surface F2 of the incident unit 141 has a cylinder shape with convexity outwardly, which has a curved surface with a radius of curvature r1. The radius of curvature r1 is about 7.5 mm. Note that as illustrated in FIG. 15, the first light of the incident light to the incident surface F2, for example, a beam L10 is emitted from the emission surface F3 as it is without passing through the total reflection surfaces f1 to f5.

The total reflection surface f5 that is the fifth total reflection surface is provided on the total reflection unit 143 at the upper side in the Y direction so as to be adjacent to the incident surface F2. The emission surface F3 of the emission unit 142 is provided at the front side in the Z direction with respect to the total reflection surface f5. The emission surface F3 of the emission unit 142 has a flat surface (the first emission surface) on the X-Y plane, and has the cutoff surface 143C as the total reflection surface f1 that is the first total reflection surface on the total reflection unit 143 that is provided at the lower side in the Y direction with respect to the emission surface F3 thereof. The total reflection surface f2 that is the second total reflection surface is provided on the total reflection unit 143 at the lower side in the Y direction so as to be adjacent to the total reflection surface f1. The total reflection surface f3 that is the third total reflection surface is provided on the total reflection unit 143 at the rear side in the Z direction and the upper side in the Y direction so as to be adjacent to the total reflection surface f2. The incident surface F2 is provided at the upper side in the Y direction so as to be adjacent to the total reflection surface f3.

The beam L1 indicates an example of the second light of the incident light to the incident surface F2. The beam L1 first enters a point p1 of the cutoff surface 143C (the total reflection surface f1). An angle γ indicates an incident angle at that time. A line V indicates a normal line against the point p1 of the cutoff surface 143C. The beam L1 is totally reflected at the point p1 of the cutoff surface 143C to become a beam L2. Subsequently, the beam L2 enters a point p2 of the total reflection surface f2 (the second total reflection surface), and is totally reflected to become a beam L3. Subsequently, the beam L3 enters a point p3 of the total reflection surface f3 (the third total reflection surface), and is totally reflected to become a beam L4. Subsequently, the beam L4 enters a point p4 of the total reflection surface f4 (the fourth total reflection surface), and is totally reflected to become a beam L5. Subsequently, the beam L5 enters a point p5 of the total reflection surface f5 (the fifth total reflection surface), and is totally reflected to become a beam L6. The beam L6 is emitted from the emission surface F3. Note that the points p2 to p5 and the corresponding total reflection surfaces exist on another sectional surface whose positions in the X direction are different from each other.

The total reflection surfaces f1 to f5 respectively have outwardly convex cylinder shapes having curved surfaces with radii of curvature R1 to R5. Each of the radii of curvature R1 to R5 is preferably 15 to 30 mm. Note that as a modification example, the total reflection surface may be configured by a flat surface. A relative angle of any two of the plurality of total reflection surfaces (the total reflection surfaces f1 to f5) of the light guide 14 is adjusted and designed so that a light cut by the total reflection surface of the incident light is efficiently emitted from the emission surface F3 by multiple times of total reflection through the total reflection surfaces. Further, as a modification example, a reflective coating may be formed on a part of the total reflection surfaces. In particular, the total reflection surface f5 needs to reflect the beam so as to be substantially parallel to the emission surface F3 by one reflection. Thus, an incident angle of the light flux becomes close to a critical angle. Therefore, it may be more significant to form a reflective coating on the total reflection surface f5 in consideration of an error such as a mounting angle.

In particular, FIG. 15 illustrates an angle β regarding the cutoff surface 143C that is the first total reflection surface. The angle β is an angle with respect to the optical axis (the Z direction). A critical angle θc of the total reflection is illustrated on the cutoff surface 143C. A line C is a line that forms the critical angle θc from the line V. The critical angle θc is an angle that is obtained in accordance with an index of refraction of a member of the light guide 14. The angle β of the cutoff surface 143C is set so that the incident angle γ of the beam (for example, the beam L1) of the light flux 15*b* for the low beam becomes larger than the critical angle θc by a predetermined angle α (γ=θc+α). This angle α is 3° or larger.

Depending upon the configuration of the light guide 14 that satisfies the angle condition described above, the light leaking out from the cutoff surface 143C becomes zero, that is, the reflection by the cutoff surface 143C becomes total reflection. This makes it possible to form a good cutoff line for the low beam.

[Light Distribution Control Light Guide for Low Beam (6)]

In order to form the light guide 14 at low cost, injection molding using a transparent resin is preferable as a manufacturing method and a constituent material. The light guide 14 can be formed by the injection molding using the transparent resin. As the transparent resin, for example, acrylic resin (in particular, PMMA: polymethyl methacrylate), polycarbonate (PC), cycloolefin resin, and the like are suitable. In the embodiment, the light guide 14 is formed by using the PMMA as the transparent resin, for example. In that case, in a case where a critical angle obtained from an index of refraction of 1.49 of the PMMA in a visible light is the critical angle θc and the index of refraction of the PMMA is n, there is a relationship of Sin θc=1/n. Therefore, the critical angle θc becomes about 42°. The angle β of the cutoff surface 143C is set on the basis of this critical angle θc.

As described above, the incident light to the light guide 14 is narrowed down to the extent through the LED collimator 13. The beam corresponding to the second light of the incident light obliquely enters the cutoff surface 143C as in the example of the beam L1. The shape including the plurality of total reflection surfaces is designed so as to satisfy a condition that this beam becomes larger than the critical angle θc of the cutoff surface 143C by the predetermined angle α (for example, 3°).

Further, while satisfying this condition, it is necessary to convert the direction (the corresponding angle) of the beam of the incident light into a front direction from the emission surface F3 (the front side in the Z direction) by means of multiple times of total reflection by the plurality of total reflection surfaces of the light guide 14. For that purpose, it is necessary to use at least five times of total reflection as the configuration of the plurality of total reflection surfaces of the light guide 14. Note that in case of four times of total reflection, suitable light distribution cannot be realized due to the condition of the critical angle. Further, it can also be configured so as to increase the number of times of total reflection to six times or seven times. However, in that case, a size thereof including the thickness of the light guide 14 becomes larger.

Further, it is desirable that a shape of the light flux comprehensively emitted from the emission surface F3 is formed into a uniform semi-elliptical shape having an arc at an upper side thereof as illustrated in FIG. 12. This is due to compatibility with the cutoff line for the low beam, that is, because final light distribution characteristics of the low beam are caused to have a shape with a string at an upper side thereof and an arc at a lower side thereof as illustrated in (A) of FIG. 20, which will be described later. The second light that enters the cutoff surface 143C (the first total reflection surface) of the incident light becomes a semi-elliptical shape having an arc at a lower side thereof. An optical image of the second light is inverted up and down in the Y direction due to total reflection. In order for a semi-elliptical shape to have an arc at an upper side thereof when the light flux of the second light is emitted from the emission surface F3, the number of times of total reflection is set to an odd number as a condition. Note that in a case where the number of times of total reflection is set to an even number, the optical image of the second light becomes a semi-elliptical shape having an arc at a lower side thereof on the emission surface F3, thereby being different from a semi-elliptical shape having an arc at an upper side thereof of the first light.

In consideration of each of the conditions described above, it is optimal that the number of times of total reflection by the light distribution controlling light guide for the low beam is five times. Correspondingly, in the headlight apparatus 1 according to the embodiment, the light guide 14 has the five total reflection surfaces f1 to f5 for five times of total reflection. As a result, the light guide 14 realizes suitable light distribution of the light emitted for the low beam while having a thickness as small as possible.

[Light Distribution Control Light Guide for High Beam (1)]

Figure 16:
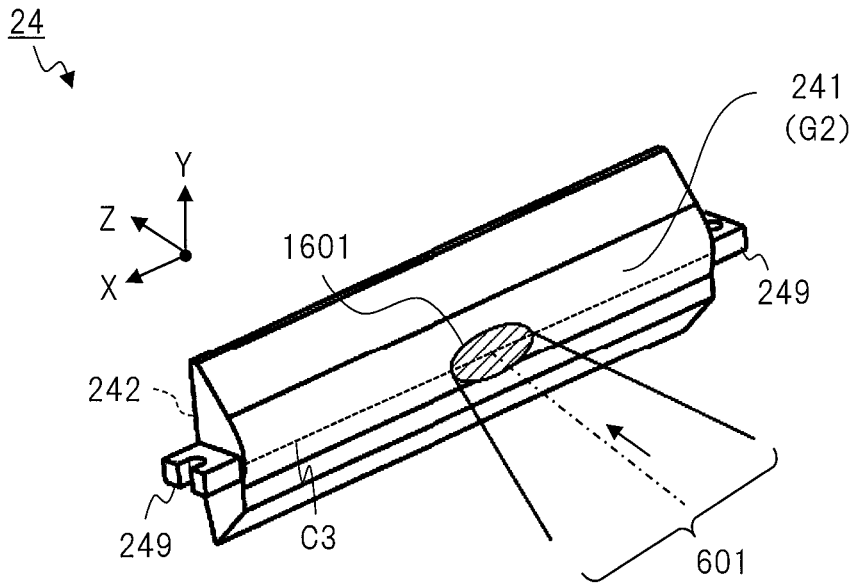
FIG. 16 is a perspective view illustrating a configuration of an incident side of alight distribution controlling light guide for the high beam in the headlight apparatus according to the embodiment.
Figure 17:
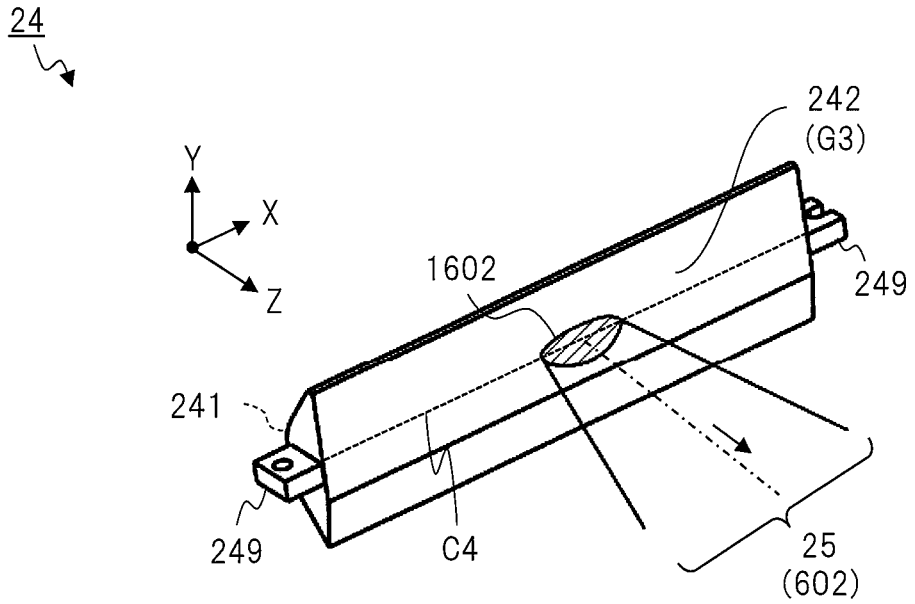
FIG. 17 is a perspective view illustrating a configuration of an emission side of the light distribution controlling light guide for the high beam in the headlight apparatus according to the embodiment.
Figure 18:
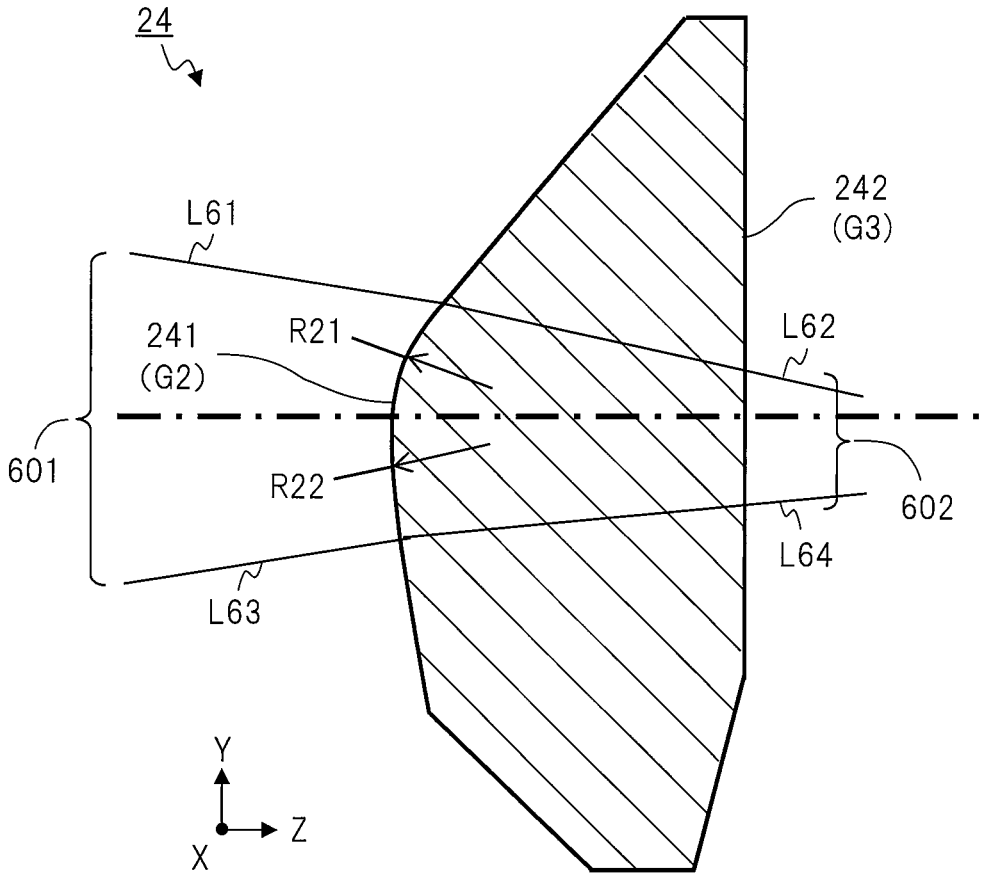
FIG. 18 is a view illustrating a vertical section of the light distribution controlling light guide for the high beam in the headlight apparatus according to the embodiment.
Figure 19:
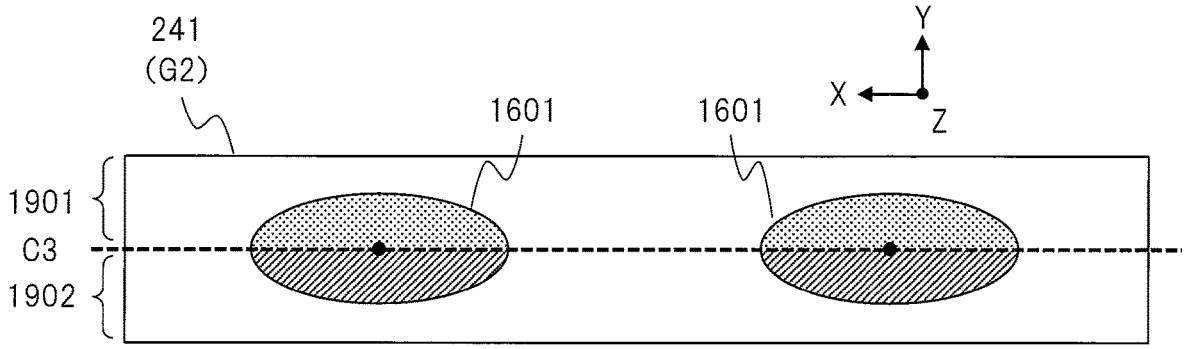
FIG. 19 is a view illustrating light flux area shapes of an incident surface and an emission surface of the light distribution controlling light guide for the high beam in the headlight apparatus according to the embodiment.
Figure 19:
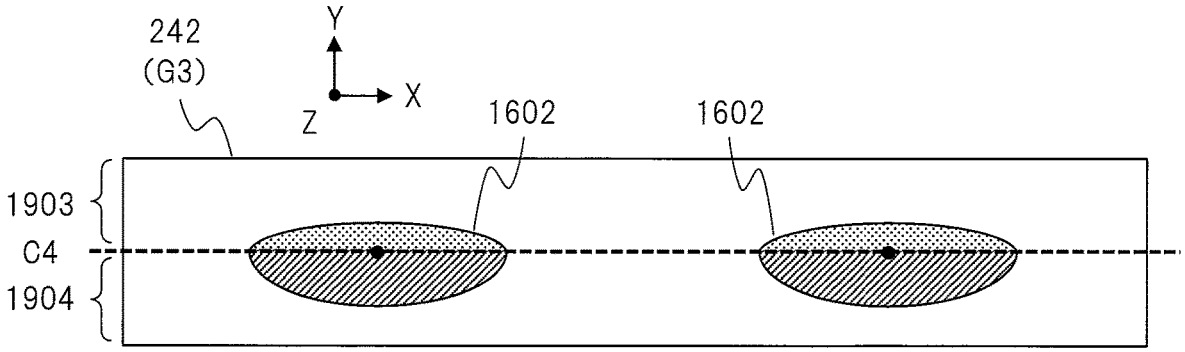

The light guide 24 that is the light distribution controlling light guide for the high beam in the high beam headlight 20 will be described with reference to FIG. 16 to FIG. 19. FIG. 16 illustrates a perspective view of a configuration of the light guide 24. FIG. 16 illustrates a perspective view of the light guide 24 when the incident surface G2 of the incident unit of the light guide 24 is viewed from the rear side in the Z direction (the LED collimator 23 side). FIG. 17 illustrates a perspective view of the light guide 24 when the emission surface G3 of the emission unit of the light guide 24 is viewed from the front side in the Z direction (the projector lens 21 side). FIG. 18 illustrates a vertical section (the Y-Z plane) of the light guide 24 at the optical axis position. FIG. 19 illustrates a planar configuration of the X-Y plane when the incident surface G2 and the emission surface G3 of the light guide 24 are viewed in the Z direction. Note that FIG. 16 and FIG. 17 illustrate a light flux from one LED collimator 23 for one light guide 24, but as illustrated in FIG. 3 and FIG. 19, in an implementation example, one light guide 24 has two light fluxes from two LED collimators 23.

In FIG. 16, the light guide 24 includes an incident unit 241, an emission unit 242, installation units 249, and the like. Each of the installation unit 249 is a unit for positioning and mounting the light guide 24 to the headlight case 30.

The incident unit 241 has the incident surface G2 that extends long in the X direction. The incident surface G2 has a cylinder shape with convexity to the incident side, and has a curved surface whose curvature is different depending upon a position in the Y direction. This incident surface G2 has a vertically asymmetrical shape in the Y direction. The incident surface G2 has an asymmetrical shape between an upper portion and a lower portion with respect to a reference line C3 indicated by a broken line, which extends in the X direction corresponding to the optical axis position. Specifically, with respect to the reference line C3, the upper portion has a curved surface whose curvature is larger than that of the lower portion.

An area 1601 of the light flux of the incident light (the light 601) from the LED collimator 23 is illustrated at the optical axis position on the incident surface G2. As illustrated in FIG. 6 and FIG. 7, the area 1601 has a slightly horizontally (the X direction) long elliptical shape in accordance with light distribution of a light condensed from the LED collimator 23.

In FIG. 17, the emission unit 242 of the light guide 24 has the emission surface G3 that extends long in the X direction. The emission surface G3 has a planar shape in the X-Y plane. An area 1602 of the light flux of the emitted light is illustrated at the optical axis position on the emission surface G3. In contrast to the elliptical shape of the area 1601, the elliptical shape of the area 1602 becomes a shape in which a portion of an upper side is narrowed compared with a portion of a lower side with respect to a reference line C4 that extends in the X direction corresponding to the optical axis position.

[Light Distribution Control Light Guide for High Beam (2)]

FIG. 18 illustrates the cylinder shape of the incident surface G2 in the incident unit 241 of the light guide 24. In this cylinder shape, a radius of curvature R21 is 2 to 5 mm, for example, in an area of an upper side in the Y direction with respect to the optical axis (indicated by an alternate long and short dash line), and a radius of curvature R22 is 5 to 20 mm, for example, in an area of a lower side thereof. The radius of curvature R21 in the area of the upper side is smaller than the radius of curvature R22 in the area of the lower side (R21<R22). In the incident light (the light 601) from the LED collimator 23, for example, a beam that enters the area of the upper side of the incident surface G2 is greatly refracted compared with a beam that enters the area of the lower side. For example, a beam L61 of the upper side becomes a beam L62, which is emitted. A beam L63 of the lower side becomes a beam L64, which is emitted. Correspondingly, on the emission surface G3 of the emission unit 242, an area of a light flux for the high beam that corresponds to the emitted light (the light 602) becomes a vertically asymmetrical shape in the Y direction.

In FIG. 19, (A) illustrates the areas 1601 of the light fluxes of the incident light on the incident surface G2, and (B) illustrates the areas 1602 of the light fluxes of the emitted light on the emission surface G3. Note that FIG. 19 illustrates a state where light fluxes of two kinds of incident lights from two LED collimators 23 are generated in one light guide 24.

In (A), the incident surface G2 has an area 1901 of an upper side and an area 1902 of a lower side with respect to a reference line C3 that extends in the X direction corresponding to the optical axis position. Curvature of the area 1901 of the upper side is larger than that of the area 1902 of the lower side. Each of the areas 1601 of the incident light has a portion of an upper side (indicated by a dot pattern) for entering the area 1901 of the upper side and a portion of a lower side (indicated by a diagonal line pattern) for entering the area 1902 of the lower side with respect to the reference line C3. The portion of the upper side has a semi-elliptical shape with an arc at the upper side, and the portion of the lower side has a semi-elliptical shape with an arc at the lower side.

Similarly, (B) illustrates the areas 1602 of the light fluxes of the emitted light on the emission surface G3 with respect to the reference line C4. Each of these areas 1602 has a portion of an upper side (indicated by a dot pattern) for entering an area 1903 of the upper side and a portion of a lower side (indicated by a diagonal line pattern) for entering an area 1904 of the lower side. As well as (A), the portion of the upper side and the portion of the lower side respectively have semi-elliptical shapes. The portion of the upper side in the area 1602 of the emitted light is refracted through the light guide 24, thereby becoming a shape in which a length thereof in the Y direction is narrowed compared with that of the portion of the upper side illustrated in (A).

Note that as described above, the shape of the light guide 24 at the high beam side is not limited to the configuration with the vertically asymmetrical shape on the incident surface G2 of the incident unit 241, and can be any configuration. Similarly, it may be configured so as to have a vertically asymmetrical shape at a predetermined position on the optical axis within a range from the incident surface G2 to the emission surface G3.

[Light Distribution Characteristics]

Figure 20:
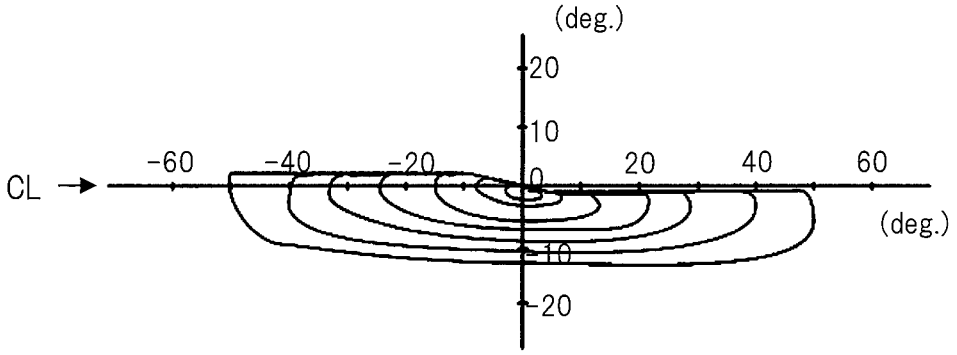
FIG. 20 is a view illustrating light distribution characteristics of the low beam and the high beam in the headlight apparatus according to the embodiment.
Figure 20:
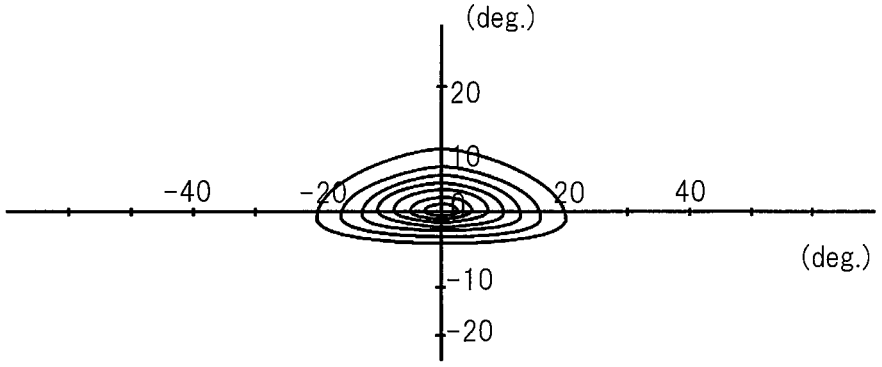

(A) of FIG. 20 illustrates light distribution characteristics of the low beam by the low beam headlight 10. This low beam corresponds to the light 403 emitted from the projector lens 11 and the light flux 15*c* for the low beam illustrated in FIG. 4 and the like. In a graph illustrated in FIG. 20, a horizontal axis indicates an angle [deg. (°)] in the horizontal direction (the X direction), and a vertical axis indicates an angle [deg. (°)] in the vertical direction (the Y direction). FIG. 20 illustrates light distribution when the rear side thereof (that is, a vehicle side) is viewed from the front side in the Z direction (that is, a point at infinity side) in case of the headlight apparatus 1*a* provided at the right side of the vehicle 2 illustrated in FIG. 1.

In (A), a straight line of the horizontal axis corresponds to a cutoff line CL of the low beam. As illustrated in (A) of FIG. 20, this light distribution of the low beam has light distribution at a substantially lower side of the vertical direction (the Y direction) with respect to the cutoff line CL. In the present embodiment, there is a distribution in a range of about 0° to −12° in the Y direction. Moreover, this light distribution has wide light distribution in the horizontal direction (the X direction) in an area of the lower side. In the present embodiment, there is a distribution in a range of about −50° to +50° in the X direction. Namely, the low beam has a wider illumination in the X direction than the high beam. As a result, the headlight apparatus 1 can illuminate, as the low beam, a wide area including the right and left in front of the vehicle 2.

Note that an area at the left side in the X direction has light distribution slightly wider toward the upper side with respect to the cutoff line C compared with an area at the right side thereof. This light distribution is designed as a horizontally asymmetrical shape as suitable light distribution corresponding to the headlight apparatus 1*a* provided at the right side so that a roadside strip (the left side in FIG. 20) can be illuminated more than an oncoming vehicle (the right side in FIG. 20).

Similarly, (B) of FIG. 20 illustrates light distribution characteristics of the high beam of the high beam headlight 20. As illustrated in (B) of FIG. 20, this light distribution of the high beam has light distribution in which an area at an upper side in the Y direction is wider than an area at a lower side with respect to a straight line of a horizontal axis (corresponding to the cutoff line CL) as a reference. In the present embodiment, the Y direction has a distribution in a range of about −5° to +10°, and the X direction has a distribution in a range of about −20° to +20°. This high beam has light distribution that is more concentrated in the center than the low beam. Each of the areas 1602 of the light fluxes of the light emitted from the light guide 24 illustrated in (B) of FIG. 19 has a wide shape at the lower side. However, as illustrated in (B) of FIG. 20, the light distribution has a wide shape at the upper side through a flip vertical action on a light path. Thus, the high beam has suitable light distribution with strong light distribution in the center.

Further, in the headlight apparatus 1 according to the embodiment, when the high beam is illuminated, both the low beam of (A) and the high beam of (B) are controlled so as to be turned on (ON) as described above. For that reason, the light distribution of the high beam of (B) is designed to have a shape in which the area at the lower side is wider than the area at the upper side with respect to the reference straight line of the horizontal axis (corresponding to the cutoff line CL). Since the area at the lower side in the high beam can be supplemented by the light of the low beam, it is designed as light distribution with a relatively wide upper side in this manner. Thus, in the headlight apparatus 1 according to the embodiment, the suitable light distribution is realized by synthesis and combination of the low beam and the high beam.

[Effects and the Like]

According to the headlight apparatus of the embodiment, it is possible to realize thin and improvement of light utilization efficiency in a case where a mechanism for emitting a low beam and a high beam is provided. In addition, it is possible to realize suitable light distribution characteristics required for the low beam and the high beam. In the headlight apparatus 1 according to the embodiment, LED elements (the LEDs 12 and 22) that easily realizes thinner than a conventional light source device are used as solid light sources. Further, the headlight apparatus 1 uses light source condensing optical systems (the LED collimators 13 and 23) that match the LED elements. The headlight apparatus 1 includes light guides (the light guides 14 and 24) devised to be capable of realizing thin in accordance with the configuration of the LEDs and the LED collimators.

In the low beam headlight 10 side, this light guide 14 is configured so as to have the plurality of total reflection surfaces at portions except for the incident surface F2 and the emission surface F3 in order to form a cutoff line for the low beam. In other words, this light guide 14 itself includes a cutoff line forming function. In the headlight apparatus 1, by using this light guide 14, it is not necessary to provide a shade or the like, which is a light shielding member, that is, any space or cost for providing the shade or the like is not required.

In the headlight apparatus 1 according to the embodiment, the LEDs, the LED collimators, the light guides, and the projector lenses are disposed along the optical axis direction, whereby the thickness of the whole apparatus can be realized to be thinner like the thickness T1 illustrated in FIG. 5. Since the thin headlight can be realized, for example, this can contribute improvement of the degree of freedom in an exterior design (or design) of a vehicle. Further, in addition, the headlight apparatus 1 reuses the light from the LED 12 at the low beam headlight 10 side without leaking the light due to the structure of total reflection by the light guide 14, thereby realizing efficient light distribution. Much component (for example, 60% or higher) of 100% of the light energy from the LED 12 can be used as the low beam, and this makes it possible to heighten light utilization efficiency compared with the conventional ones.

Further, in the headlight apparatus 1 according to the embodiment, as illustrated in FIG. 15, by adopting the structure of the light guide 14 that satisfies the condition regarding the critical angle of total reflection, the cutoff line of the low beam can be set to a suitable linear shape as illustrated in (A) of FIG. 20. In the light distribution of the low beam, it is possible to avoid the light from wastefully leaking from the cutoff line to the upper side thereof, and this makes it possible to realize suitable light distribution.

Further, in the headlight apparatus 1 according to the embodiment, suitable light distribution of the high beam can be realized at the high beam headlight 20 side. As illustrate in FIG. 16 and the like, the light guide 24 particularly has a vertically asymmetrical cylinder shape at the incident surface G2 side. This makes it possible to make the headlight apparatus 1 thinner and realize suitable light distribution of the high beam. Further, the headlight apparatus 1 according to the embodiment not only can be made thinner, but also can realize a suitable beam in the configuration of combination of the high beam headlight 20 and the low beam headlight 10.

The following are also possible as headlight apparatuses according to other embodiments. In the headlight apparatus 1 according to the embodiment described above, the low beam headlight 10 that is the low beam emitting mechanism and the high beam headlight 20 that is the high beam emitting mechanism are independently configured, and they are disposed in parallel in the X direction. The headlight apparatus according to the other embodiment can be configured so as to include only the low beam headlight 10, or to include only the high beam headlight 20. Further, in a case where a thickness of the headlight apparatus in the Y direction is made larger and a width thereof in the X direction is made smaller, the headlight apparatus can be configured so that the low beam headlight 10 and the high beam headlight 20 are disposed in an overlapping manner in the Y direction.

As the headlight apparatus according to still another embodiment, the headlight apparatus may be configured so as to add optical elements, such as a polarization converting element, a light distribution control element, another lens, or a mirror, onto the light path in addition to the components such as the light guide described above.

As described above, the present invention has been described specifically on the basis of the embodiment. However, the present invention is not limited to the embodiment described above, and the present invention may be modified into various forms without departing from the substance thereof. The configuration of the embodiment can be added with the other configuration, deleted or replaced thereby.

REFERENCE SIGNS LIST

1, 1*a* . . . headlight apparatus, 10 . . . low beam headlight, 20 . . . high beam headlight, 10*a*, 10*b*, 10*c* . . . low beam unit,

20*a*, 20*b* . . . high beam unit, 11, 21 . . . projector lens, 12, 22 . . . LED, 13, 23 . . . LED collimator, 14, 24 . . . light guide, 32 . . . LED substrate, F1, F3, F5 . . . emission surface, and F2, F4 . . . incident surface.

The invention claimed is:

1. A headlight apparatus to be mounted on a vehicle, the headlight apparatus comprising:

a low beam headlight configured to emit a low beam, wherein the low beam headlight includes:

a solid light source for the low beam;

a light source condensing optical system for the low beam configured to condense a light emitted from the solid light source for the low beam, the light source condensing optical system for the low beam being disposed on an optical axis of the solid light source for the low beam;

a light distribution controlling light guide for the low beam disposed on the optical axis, a light from the light source condensing optical system for the low beam entering the light distribution controlling light guide for the low beam, the light distribution controlling light guide for the low beam being configured to control light distribution thereof and emit a light; and a projector lens for the low beam disposed on the optical axis, the light from the light distribution controlling light guide for the low beam entering the projector lens for the low beam, the projector lens for the low beam being configured to project a light, wherein the light distribution controlling light guide for the low beam includes:

an incident surface that the light from the light source condensing optical system for the low beam enters;

a plurality of total reflection surfaces; and an emission surface from which the light to the projector lens for the low beam is emitted, and wherein a first light of incident light from the incident surface is emitted from the emission surface without reaching the plurality of total reflection surfaces, and a second light of the incident light is emitted from the emission surface via multiple times of total reflection by the plurality of total reflection surfaces.

2. The headlight apparatus according to claim 1, wherein the solid light source for the low beam is configured by an LED element, and wherein the light source condensing optical system for the low beam is configured by an LED collimator.

3. The headlight apparatus according to claim 2, wherein the LED collimator includes:

an incident side refractive element disposed so as to face a light emitting face of the LED element;

a side surface reflector configured to totally reflect a light from the LED element; and an emission side refractive element configured to emit lights from the incident side refractive element and the side surface reflector.

4. The headlight apparatus according to claim 1, wherein on a sectional surface formed by a direction of the optical axis of the low beam headlight and a vertical direction, the emission surface has an emission surface area provided at an upper side of the optical axis, and the plurality of total reflection surfaces has a first total reflection surface provided at a lower side of the optical axis and obliquely with respect to the emission surface area.

5. The headlight apparatus according to claim 1, wherein the second light undergoes multiple times of total reflection by the plurality of total reflection surfaces to travel outward in a first horizontal direction with respect to the optical axis, and is emitted from the emission surface.

6. The headlight apparatus according to claim 1, wherein the plurality of total reflection surfaces is an odd number of total reflection surfaces.

7. The headlight apparatus according to claim 6, wherein the odd number of total reflection surfaces is five total reflection surfaces.

8. The headlight apparatus according to claim 1, wherein an incident angle when the second light enters a first total reflection surface of the plurality of total reflection surfaces is an angle larger than a critical angle of total reflection by 3° or larger.

9. The headlight apparatus according to claim 1, further comprising:

a high beam headlight configured to emit a high beam, wherein the high beam headlight includes:

a solid light source for the high beam;

a light source condensing optical system for the high beam configured to condense a light emitted from the solid light source for the high beam, the light source condensing optical system for the high beam being disposed on an optical axis of the solid light source for the high beam;

a light distribution controlling light guide for the high beam disposed on the optical axis, a light from the light source condensing optical system for the high beam entering the light distribution controlling light guide for the high beam, the light distribution controlling light guide for the high beam being configured to control light distribution thereof and emit a light; and a projector lens for the high beam disposed on the optical axis, the light from the light distribution controlling light guide for the high beam entering the projector lens for the high beam, the projector lens for the high beam being configured to project a light, wherein the light distribution controlling light guide for the high beam include:

an incident surface that the light from the light source condensing optical system for the high beam enters; and an emission surface from which the light to the projector lens for the high beam is emitted, and wherein at least one of the incident surface or the emission surface of the light distribution controlling light guide for the high beam has a vertically asymmetrical shape in the vertical direction on a sectional surface formed by a direction of the optical axis and the vertical direction.

10. The headlight apparatus according to claim 9, wherein the incident surface of the light distribution controlling light guide for the high beam has a columnar surface shape with a curved surface in the vertical direction, and wherein the vertically asymmetrical shape in the vertical direction is a shape in which curvature of a first area of an upper side is larger than that of a second area of a lower side.

11. The headlight apparatus according to claim 9, wherein the solid light source for the high beam is configured by an LED element, and wherein the light source condensing optical system for the high beam is configured by an LED collimator.

12. The headlight apparatus according to claim 11, wherein the LED collimator includes:

an incident side refractive element disposed so as to face a light emitting face of the LED element;

a side surface reflector configured to totally reflect a light from the LED element; and an emission side refractive element configured to emit lights from the incident side refractive element and the side surface reflector.

13. A headlight apparatus to be mounted on a vehicle, the headlight apparatus comprising:

a high beam headlight configured to emit a high beam, wherein the high beam headlight includes:

a solid light source for the high beam;

a light source condensing optical system for the high beam configured to condense a light emitted from the solid light source for the high beam, the light source condensing optical system for the high beam being disposed on an optical axis of the solid light source for the high beam;

a light distribution controlling light guide for the high beam disposed on the optical axis, a light from the light source condensing optical system for the high beam entering the light distribution controlling light guide for the high beam, the light distribution controlling light guide for the high beam being configured to control light distribution thereof and emit a light; and a projector lens for the high beam disposed on the optical axis, the light from the light distribution controlling light guide for the high beam entering the projector lens for the high beam, the projector lens for the high beam being configured to project a light, wherein the light distribution controlling light guide for the high beam include:

an incident surface that the light from the light source condensing optical system for the high beam enters; and an emission surface from which the light to the projector lens for the high beam is emitted, wherein at least one of the incident surface or the emission surface of the light distribution controlling light guide for the high beam has a vertically asymmetrical shape in the vertical direction on a sectional surface formed by a direction of the optical axis and the vertical direction, wherein the incident surface of the light distribution controlling light guide for the high beam has a columnar surface shape with a curved surface in the vertical direction, and wherein the vertically asymmetrical shape in the vertical direction is a shape in which curvature of a first area of an upper side is larger than that of a second area of a lower side.

14. A headlight apparatus to be mounted on a vehicle, the headlight apparatus comprising:

a high beam headlight configured to emit a high beam, wherein the high beam headlight includes:

a solid light source for the high beam;

a light source condensing optical system for the high beam configured to condense a light emitted from the solid light source for the high beam, the light source condensing optical system for the high beam being disposed on an optical axis of the solid light source for the high beam;

a light distribution controlling light guide for the high beam disposed on the optical axis, a light from the light source condensing optical system for the high beam entering the light distribution controlling light guide for the high beam, the light distribution controlling light guide for the high beam being configured to control light distribution thereof and emit a light; and a projector lens for the high beam disposed on the optical axis, the light from the light distribution controlling light guide for the high beam entering the projector lens for the high beam, the projector lens for the high beam being configured to project a light, wherein the light distribution controlling light guide for the high beam include:

an incident surface that the light from the light source condensing optical system for the high beam enters; and an emission surface from which the light to the projector lens for the high beam is emitted, wherein at least one of the incident surface or the emission surface of the light distribution controlling light guide for the high beam has a vertically asymmetrical shape in the vertical direction on a sectional surface formed by a direction of the optical axis and the vertical direction, wherein the solid light source for the high beam is configured by an LED element, and wherein the light source condensing optical system for the high beam is configured by an LED collimator.

15. The headlight apparatus according to claim 14, wherein the LED collimator includes:

an incident side refractive element disposed so as to face a light emitting face of the LED element;

a side surface reflector configured to totally reflect a light from the LED element; and an emission side refractive element configured to emit lights from the incident side refractive element and the side surface reflector.

* * * * *